US010538350B2

(12) United States Patent
Lancaster, III et al.

(10) Patent No.: US 10,538,350 B2
(45) Date of Patent: Jan. 21, 2020

(54) STRETCH WRAPPING MACHINE SUPPORTING TOP LAYER CONTAINMENT OPERATIONS

(71) Applicant: Lantech.com, LLC, Louisville, KY (US)

(72) Inventors: Patrick R. Lancaster, III, Louisville, KY (US); Michael P. Mitchell, Louisville, KY (US); Richard L. Johnson, LaGrange, KY (US)

(73) Assignee: LANTECH.COM, LLC, Louisville, KY (US)

( * ) Notice: Subject to any disclaimer, the term of this patent is extended or adjusted under 35 U.S.C. 154(b) by 0 days.

(21) Appl. No.: 15/565,641

(22) PCT Filed: Apr. 8, 2016

(86) PCT No.: PCT/US2016/026723

§ 371 (c)(1),
(2) Date: Oct. 10, 2017

(87) PCT Pub. No.: WO2016/164776

PCT Pub. Date: Oct. 13, 2016

(65) Prior Publication Data

US 2018/0079537 A1 Mar. 22, 2018

Related U.S. Application Data

(60) Provisional application No. 62/145,789, filed on Apr. 10, 2015, provisional application No. 62/232,906, filed on Sep. 25, 2015.

(51) Int. Cl.
*B65B 11/58* (2006.01)
*B65B 11/02* (2006.01)
(Continued)

(52) U.S. Cl.
CPC ..... *B65B 11/585* (2013.01); *B65B 11/025* (2013.01); *B65B 11/045* (2013.01);
(Continued)

(58) Field of Classification Search
CPC ..... B65B 11/585; B65B 11/02; B65B 57/12; B65B 57/04; B65B 65/02; B65B 41/16;
(Continued)

(56) References Cited

U.S. PATENT DOCUMENTS 4,281,500 A 8/1981 Mueller et al.
4,712,686 A * 12/1987 Lancaster ..... A01F 15/071 206/597
(Continued)

FOREIGN PATENT DOCUMENTS

AU 2016246778 6/2019
DE 3100371 A1 2/1988
(Continued)

OTHER PUBLICATIONS

International Search Report and Written Opinion for PCT/US2016/026723 dated Jul. 8, 2016.
(Continued)

*Primary Examiner* — Chelsea E Stinson
*Assistant Examiner* — Thomas M Wittenschlaeger
(74) *Attorney, Agent, or Firm* — Middleton Reutlinger

(57) ABSTRACT

A method, apparatus and program product implement top layer containment operations to optimize containment of various types of loads such as loads with top/slip sheets, ragged topographies, and/or inboard portions. Bidirectional control of the elevation of a web of packaging material may be performed within one or more revolutions between a load and a packaging material dispenser to selectively engage one or more corners of the load with a web of packaging material
(Continued)

while passing the web of packaging material inwardly of one or more other corners of the load.

41 Claims, 20 Drawing Sheets

(51) Int. Cl.

| | |
|---|---|
| ***B65B 41/16*** | (2006.01) |
| ***B65B 57/04*** | (2006.01) |
| ***B65B 57/12*** | (2006.01) |
| ***B65B 65/02*** | (2006.01) |
| ***B65B 61/20*** | (2006.01) |
| ***B65B 11/04*** | (2006.01) |
| *B65B 11/00* | (2006.01) |

(52) U.S. Cl.
CPC ..... *B65B 41/16* (2013.01); *B65B 57/04* (2013.01); *B65B 57/12* (2013.01); *B65B 61/202* (2013.01); *B65B 65/02* (2013.01); *B65B 2011/002* (2013.01); *B65D 2571/00018* (2013.01)

(58) Field of Classification Search
CPC ... B65B 11/025; B65B 11/045; B65B 61/202; B65B 2011/002; B65D 2571/00018
See application file for complete search history.

(56) References Cited

U.S. PATENT DOCUMENTS

| | | | | |
|---|---|---|---|---|
| 4,726,172 | A | 2/1988 | Widenback | |
| 5,212,933 | A | 5/1993 | Cere' | |
| 5,421,141 | A | 6/1995 | Gordon | |
| 5,447,008 | A * | 9/1995 | Martin-Cocher | B65B 11/025 53/399 |
| 5,463,842 | A * | 11/1995 | Lancaster | B65B 11/045 53/389.4 |
| 6,848,237 | B2 | 2/2005 | Lancaster, III et al. | |
| 8,474,224 | B2 | 7/2013 | Rossi | |
| 8,772,651 | B2 | 7/2014 | Martin et al. | |
| 2003/0110737 | A1 * | 6/2003 | Lancaster, III | B65B 11/008 53/441 |
| 2003/0012683 | A1 | 7/2003 | Marchetti | |
| 2004/0129150 | A1 * | 7/2004 | Lancaster, III | B65G 61/00 99/486 |
| 2005/0150811 | A1 | 7/2005 | Spencer | |
| 2006/0254214 | A1 * | 11/2006 | Cox | B65B 11/045 53/399 |
| 2007/0204564 | A1 * | 9/2007 | Lancaster, III | B65B 11/006 53/399 |
| 2008/0007858 | A1 | 4/2008 | Draper et al. | |
| 2010/0006490 | A1 | 3/2010 | Rossi | |
| 2012/0017517 | A1 | 7/2012 | Martin et al. | |
| 2014/0116006 | A1 | 5/2014 | Lancaster, III et al. | |
| 2014/0020869 | A1 | 7/2014 | Phillips et al. | |
| 2014/0331609 | A1 * | 11/2014 | Bison | B65B 11/006 53/441 |
| 2018/0079537 | A1 | 3/2018 | Lancaster, III | |

FOREIGN PATENT DOCUMENTS

| | | | |
|---|---|---|---|
| GB | 2098569 | A | 11/1982 |
| WO | 03020591 | A1 | 3/2003 |
| WO | 2009047620 | A2 | 4/2009 |

OTHER PUBLICATIONS

Australian Patent Office; Examination Report issued in Application No. 2016246778 dated Apr. 16, 2018.
Australian Patent Office; Notice of Acceptance in Application No. 2016246778 dated Mar. 4, 2019 (420AU).
Canadian Patent Office; Notice of Allowance issued in Application No. 2,982,343 dated May 14, 2019 (420CA).
European Patent Office; Communication (dated Nov. 5, 2018) and Extended European Search Report (dated Oct. 17, 2018); Application No. 16777392.8 ; 11 pages.
European Patent Office; Communication; Application No. 16777392.8 dated Jul. 1, 2019; 1 page.
Australian Patent Office; Notice of Grant in Application No. 2016246778 dated Jun. 27, 2019.

* cited by examiner

STRETCH WRAPPING MACHINE SUPPORTING TOP LAYER CONTAINMENT OPERATIONS

CROSS-REFERENCE TO RELATED APPLICATIONS

This application claims the filing benefit of U.S. Provisional Patent Application Ser. No. 62/145,789 filed on Apr. 10, 2015 and U.S. Provisional Patent Application Ser. No. 62/232,906 filed on Sep. 25, 2015, each of which is incorporated by reference herein in its entirety.

FIELD OF THE INVENTION

The invention generally relates to wrapping loads with packaging material through relative rotation of loads and a packaging material dispenser.

BACKGROUND OF THE INVENTION

Various packaging techniques have been used to build a load of unit products and subsequently wrap them for transportation, storage, containment and stabilization, protection and waterproofing. One system uses wrapping machines to stretch, dispense, and wrap packaging material around a load. The packaging material may be pre-stretched before it is applied to the load. Wrapping can be performed as an inline, automated packaging technique that dispenses and wraps packaging material in a stretch condition around a load on a pallet to cover and contain the load. Stretch wrapping, whether accomplished by a turntable, rotating arm, vertical rotating ring, or horizontal rotating ring, typically covers the four vertical sides of the load with a stretchable packaging material such as polyethylene packaging material. In each of these arrangements, relative rotation is provided between the load and the packaging material dispenser to wrap packaging material about the sides of the load.

In many commercial applications, typical loads wrapped by a stretch wrapping machine have a substantially cuboid shape with a relatively consistent length, width and height throughout, and in many cases having a similar length and width to the supporting pallet. Generally, in these applications, loads consist of multiple layers of the same products. In other applications, however, loads may deviate from this traditional configuration, and may include portions or layers, herein referred to as inboard portions, that are substantially inboard of a supporting body upon which they are disposed and to which they must be secured. For example, loads that are palletized using an automated pallet picker may end up with less than complete layers of products on the top layer, and as such the top layer may therefore be substantially inboard from the corners of the main body of the load. In some instances, only one product, or one case of products, may be placed on the top layer of the load. As another example, some loads may have a "ragged" topography due to the inclusion of multiple products or cases of products having varying elevations at different points across the top of the load. As another example, some products loaded onto pallets may be substantially smaller in cross-section than a pallet, and may therefore be substantially inboard from the corners of the pallet.

It has been found that stretch wrapping machines that are optimized to handle typical, cuboid-shaped loads may have difficulty in securing inboard portions of loads, loads with ragged topographies in an automatic cycle, and other instances including nonstandard top layers. Many stretch wrapping machines, for example, wrap in a spiral fashion, and include an elevator system that moves an exit point of a packaging material dispenser generally parallel to the axis of relative rotation between the load and the packaging material dispenser during the relative rotation. For portions of a load that are significantly inboard, this movement parallel to the axis of relative rotation may leave flaps of packaging material that cannot reach and secure the inboard portion of the load to the pallet or to the main body of the load. Even if the exit point is moved to a point at which the packaging material clears the pallet or main body of the load and wraps the inboard portion, the inboard portion is typically secured inadequately, and in many instances, a risk exists that the packaging material will break as the edge of the material snags on the corner of the pallet or the main body of the load. Further, the ragged top surfaces of some loads may present numerous sharp points and corners that could potentially tear or puncture the packaging material.

In still other applications, it may be desirable to secure top sheets of packaging material or cardboard onto loads, e.g., to protect the top of a load from dust, moisture or damage from another load stacked on top of the load, or to secure slip sheets onto loads to support other loads that may be stacked on top of the loads. Effectively securing a top sheet or slip sheet remains problematic in some situations, particularly for loads of easily-deformable articles such as paper products and plastic bottles, since damage to articles located at the top corners of such loads may occur as a result of excessive wrap force applied to the top corners.

Therefore, a significant need continues to exist in the art for an improved manner of reliably and efficiently loads with nonstandard top layers.

SUMMARY OF THE INVENTION

The invention addresses these and other problems associated with the art by providing a method, apparatus and program product that implement top layer containment operations to optimize containment of various types of loads such as loads with top/slip sheets, ragged topographies, and/or inboard portions. Bidirectional control of the elevation of a web of packaging material may be performed within one or more revolutions between a load and a packaging material dispenser to selectively engage one or more corners of the load with a web of packaging material while passing the web of packaging material inwardly of one or more other corners of the load.

In some embodiments, for example, a load may be wrapped with a load wrapping apparatus that controls an elevation of a web of packaging material dispensed from a packaging material dispenser while providing relative rotation between the load and the packaging material dispenser about an axis of rotation, the load including four corners adjoining a top surface of the load, and the four corners including first and second pairs of opposing corners. The load may be wrapped by performing a revolution between the load and the packaging material dispenser and controlling an elevation of the web during the revolution by controlling an elevation of at least a portion of the packaging material dispenser such that the web engages each corner of the first pair of opposing corners and such that the web passes inwardly of each corner of the second pair of opposing corners. Controlling the elevation of the web may include raising the elevation of the web after engaging a corner of the first pair of opposing corners and before passing inwardly of an immediately subsequent corner of the second pair of opposing corners, and lowering the elevation of the web after passing inwardly of the immediately subsequent corner of the second pair of opposing corners and engaging an immediately subsequent corner of the first pair of opposing corners.

In addition, in some embodiments, an inboard portion of a load may be secured to a supporting body with a load wrapping apparatus, the supporting body including a plurality of corners. The inboard portion of the load may be secured by providing relative rotation between the load and a packaging material dispenser about an axis of rotation to dispense packaging material to the load, controlling an elevation of a web of the packaging material extending between the packaging material dispenser and the load generally parallel to the axis of rotation, and securing the inboard portion of the load to the supporting body within a revolution between the load and the packaging material dispenser by wrapping packaging material around a first corner of the supporting body while controlling the elevation of the web by controlling the elevation of at least a portion of the packaging material dispenser to engage the first corner of the supporting body of the load with a bottom edge of the web, after wrapping the packaging material around the first corner of the supporting body, wrapping packaging material around the inboard portion of the load on a side of the load opposite the first corner of the supporting body while controlling the elevation of the web by controlling the elevation of at least a portion of the packaging material dispenser to engage the inboard portion of the load with the bottom edge of the web, and after wrapping the packaging material around the inboard portion of the load, wrapping packaging material around at least one corner of the supporting body while controlling the elevation of the web by controlling the elevation of at least a portion of the packaging material dispenser to engage the supporting body with the bottom edge of the web.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention.

DETAILED DESCRIPTION

Embodiments consistent with the invention utilize various techniques, referred to herein as "top layer containment operations," to facilitate securement of loads with "nonstandard" top layers, e.g., loads including inboard portions, ragged topographies, etc., with a wrapping apparatus, e.g., a stretch wrapping machine. A top layer containment operation, in this regard, may be performed during at least a portion of a wrapping cycle and may be used in some embodiments to enhance containment of loads that deviate from standard cuboid-shaped loads in one or more respects. In some embodiments, for example, a top layer containment operation may be performed to secure an inboard portion of a load to a supporting body, e.g., to secure an incomplete top layer that is inboard of a main body of a load, to secure a product that is inboard of a pallet, to secure the top of a load having a ragged topography, etc. In addition, while a top layer containment operation may be performed on loads with top layers that are nonstandard from a geometrical standpoint due to a deviation from a substantially cuboid geometry, a top layer containment operation may also be performed on loads that include top layers that are nonstandard in other respects, and even on loads that may be considered to be standard in nature. In some embodiments, for example, a top layer containment operation may be used to wrap packaging material over at least a portion of a top surface of a load and inward of one or more top corners of the load, e.g., where it is desirable to secure a top or slip sheet on the load and/or where load contents proximate the top corners of the load are easily deformable or crushable.

In addition, in some embodiments, a top layer containment operation may be considered to be a user- or machine-selectable wrap sequence that is incorporated into an otherwise standard wrapping operation and that is initiated at a predetermined point within such a wrapping operation. For example, where a load has an inboard portion, a wrapping cycle may start at the bottom of a load and wrap one or more layers of packaging material spirally around the sides of the load in a generally upwardly direction until a particular elevation is reached, at which point a top layer containment operation may be initiated to perform a sequence that secures the inboard portion with packaging material. Then, upon completion of the top layer containment operation, standard spiral wrapping may recommence to spirally wrap additional layers of packaging material around the sides of the load in a generally downward direction.

Other types of top layer containment operations are contemplated and will be discussed hereinafter. Prior to a further discussion of these various operations, however, a brief discussion of various types of wrapping apparatus within which the various techniques disclosed herein may be implemented is provided.

Wrapping Apparatus Configurations

Figure 1:
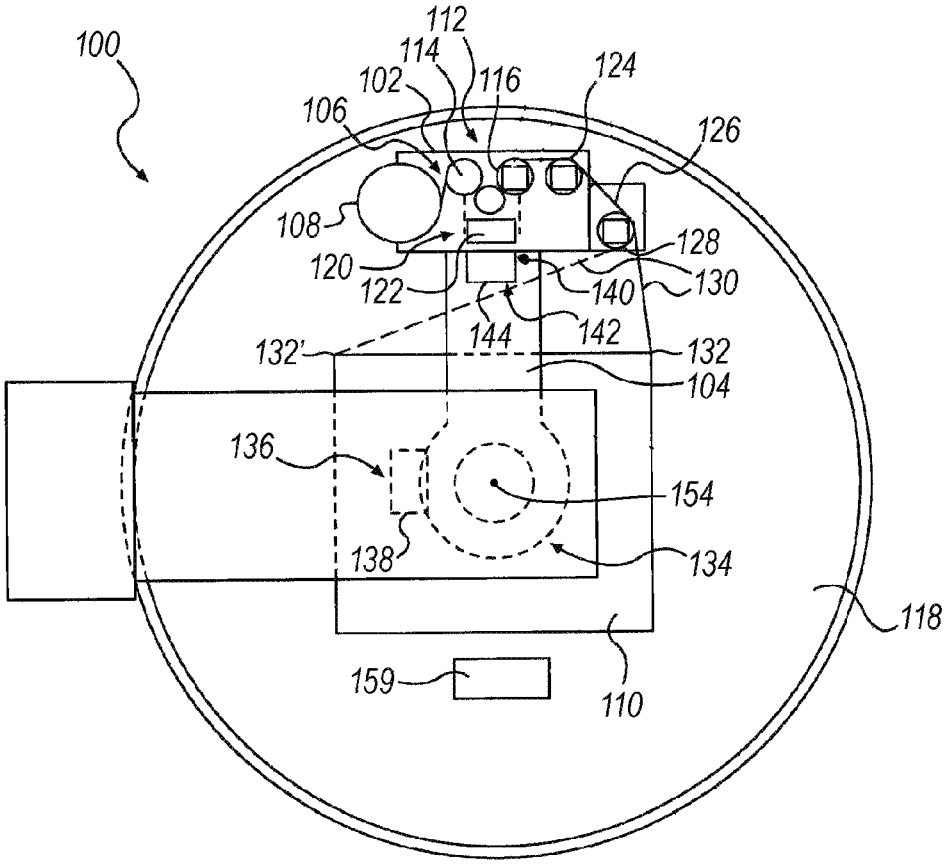
FIG. 1 shows a top view of a rotating arm-type wrapping apparatus consistent with the invention.

Various wrapping apparatus configurations may be used in various embodiments of the invention. For example, FIG. 1 illustrates a rotating arm-type wrapping apparatus 100, which includes a roll carriage or elevator 102 mounted on a rotating arm 104. Roll carriage 102 may include a packaging material dispenser 106. Packaging material dispenser 106 may be configured to dispense packaging material 108 as rotating arm 104 rotates relative to a load 110 to be wrapped. In an example embodiment, packaging material dispenser 106 may be configured to dispense stretch wrap packaging material. As used herein, stretch wrap packaging material is defined as material having a high yield coefficient to allow the material a large amount of stretch during wrapping. However, it is possible that the apparatuses and methods disclosed herein may be practiced with packaging material that will not be pre-stretched prior to application to the load. Examples of such packaging material include netting, strapping, banding, tape, etc. The invention is therefore not limited to use with stretch wrap packaging material. In addition, as used herein, the terms "packaging material," "web," "film," "film web," and "packaging material web" may be used interchangeably.

Packaging material dispenser 106 may include a pre-stretch assembly 112 configured to pre-stretch packaging material before it is applied to load 110 if pre-stretching is desired, or to dispense packaging material to load 110 without pre-stretching. Pre-stretch assembly 112 may include at least one packaging material dispensing roller, including, for example, an upstream dispensing roller 114 and a downstream dispensing roller 116. It is contemplated that pre-stretch assembly 112 may include various configurations and numbers of pre-stretch rollers, drive or driven roller and idle rollers without departing from the spirit and scope of the invention.

The terms "upstream" and "downstream," as used in this application, are intended to define positions and movement relative to the direction of flow of packaging material 108 as it moves from packaging material dispenser 106 to load 110. Movement of an object toward packaging material dispenser 106, away from load 110, and thus, against the direction of flow of packaging material 108, may be defined as "upstream." Similarly, movement of an object away from packaging material dispenser 106, toward load 110, and thus, with the flow of packaging material 108, may be defined as "downstream." Also, positions relative to load 110 (or a load support surface 118) and packaging material dispenser 106 may be described relative to the direction of packaging material flow. For example, when two pre-stretch rollers are present, the pre-stretch roller closer to packaging material dispenser 106 may be characterized as the "upstream" roller and the pre-stretch roller closer to load 110 (or load support 118) and further from packaging material dispenser 106 may be characterized as the "downstream" roller.

A packaging material drive system 120, including, for example, an electric motor 122, may be used to drive dispensing rollers 114 and 116. For example, electric motor 122 may rotate downstream dispensing roller 116. Downstream dispensing roller 116 may be operatively coupled to upstream dispensing roller 114 by a chain and sprocket assembly, such that upstream dispensing roller 114 may be driven in rotation by downstream dispensing roller 116. Other connections may be used to drive upstream roller 114 or, alternatively, a separate drive (not shown) may be provided to drive upstream roller 114.

Downstream of downstream dispensing roller 116 may be provided one or more idle rollers 124, 126 that redirect the web of packaging material, with the most downstream idle roller 126 effectively providing an exit point 128 from packaging material dispenser 102, such that a portion 130 of packaging material 108 extends between exit point 128 and a contact point 132 where the packaging material engages load 110 (or alternatively contact point 132' if load 110 is rotated in a counter-clockwise direction).

Wrapping apparatus 100 also includes a relative rotation assembly 134 configured to rotate rotating arm 104, and thus, packaging material dispenser 106 mounted thereon, relative to load 110 as load 110 is supported on load support surface 118. Relative rotation assembly 134 may include a rotational drive system 136, including, for example, an electric motor 138. It is contemplated that rotational drive system 136 and packaging material drive system 120 may run independently of one another. Thus, rotation of dispensing rollers 114 and 116 may be independent of the relative rotation of packaging material dispenser 106 relative to load 110. This independence allows a length of packaging material 108 to be dispensed per a portion of relative revolution that is neither predetermined nor constant. Rather, the length may be adjusted periodically or continuously based on changing conditions. In other embodiments, however, packaging material dispenser 106 may be driven proportionally to the relative rotation, or alternatively, tension in the packaging material extending between the packaging material dispenser and the load may be used to drive the packaging material dispenser.

Wrapping apparatus 100 may further include a lift assembly 140. Lift assembly 140 may be powered by a lift drive system 142, including, for example, an electric motor 144, that may be configured to move roll carriage 102 vertically relative to load 110. Lift drive system 142 may drive roll carriage 102, and thus packaging material dispenser 106, generally in a direction parallel to an axis of rotation between the packaging material dispenser 106 and load 110 and load support surface 118. For example, for wrapping apparatus 100, lift drive system 142 may drive roll carriage 102 and packaging material dispenser 106 upwards and downwards vertically on rotating arm 104 while roll carriage 102 and packaging material dispenser 106 are rotated about load 110 by rotational drive system 136, to wrap packaging material spirally about load 110.

In some embodiments, one or more of downstream dispensing roller 116, idle roller 124 and idle roller 126 may include a sensor to monitor rotation of the respective roller. In addition, in some embodiments, wrapping apparatus may also include an angle sensor for determining an angular relationship between load 110 and packaging material dispenser 106 about a center of rotation 154. In other embodiments, an angular relationship may be represented and/or measured in units of time, based upon a known rotational speed of the load relative to the packaging material dispenser, from which a time to complete a full revolution may be derived such that segments of the revolution time would correspond to particular angular relationships. Other sensors may also be used to determine the height and/or other dimensions of a load, among other information.

Wrapping apparatus 100 may also include additional components used in connection with other aspects of a wrapping operation. For example, a clamping device 159 may be used to grip the leading end of packaging material 108 between cycles. In addition, a conveyor (not shown) may be used to convey loads to and from wrapping apparatus 100. Other components commonly used on a wrapping apparatus will be appreciated by one of ordinary skill in the art having the benefit of the instant disclosure.

Figure 2:
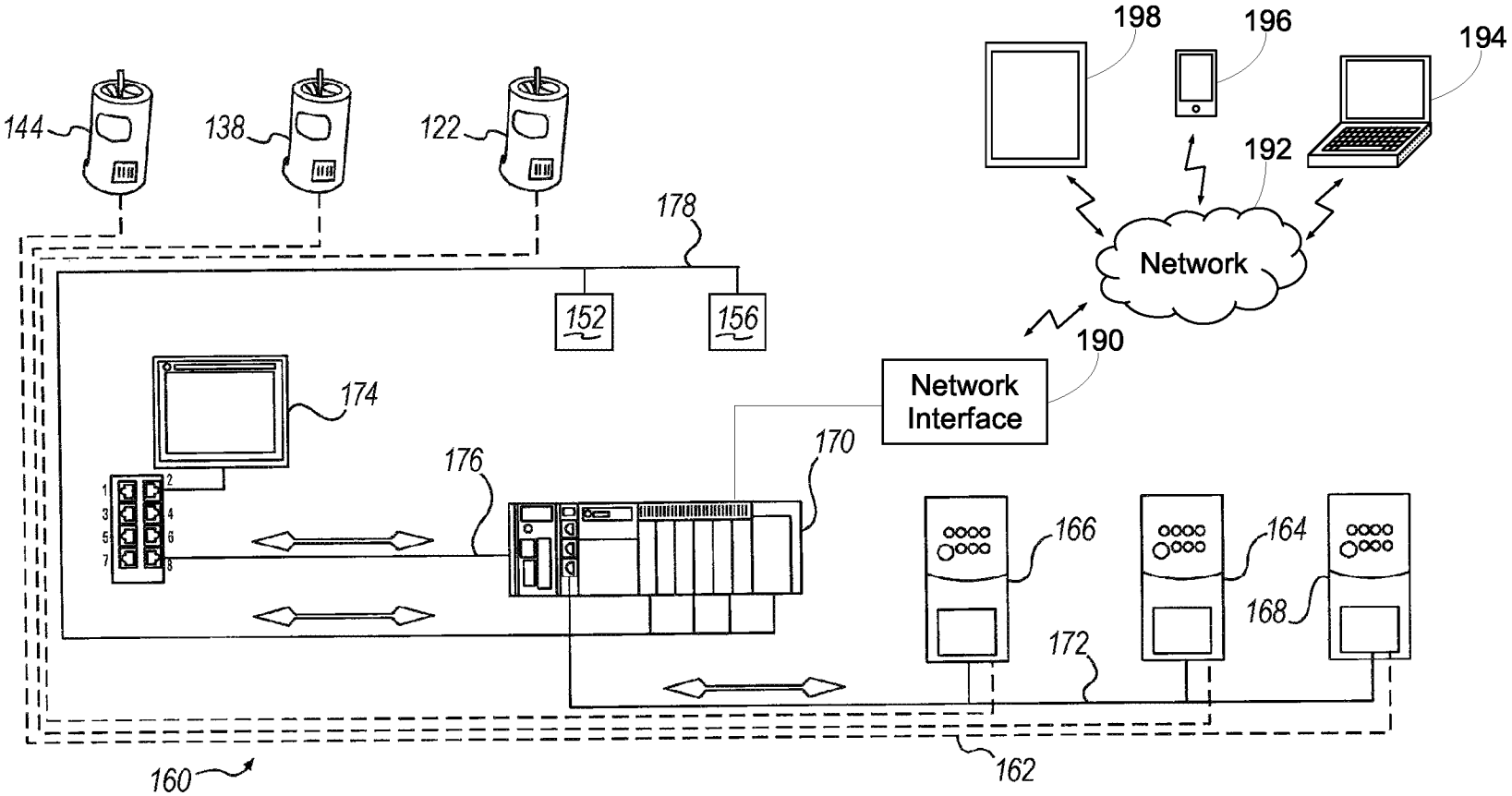
FIG. 2 is a schematic view of an example control system for use in the apparatus of FIG. 1.

An example schematic of a control system 160 for wrapping apparatus 100 is shown in FIG. 2. Motor 122 of packaging material drive system 120, motor 138 of rotational drive system 136, and motor 144 of lift drive system 142 may communicate through one or more data links 162 with a rotational drive variable frequency drive ("VFD") 164, a packaging material drive VFD 166, and a lift drive VFD 168, respectively. Rotational drive VFD 164, packaging material drive VFD 166, and lift drive VFD 168 may communicate with controller 170 through a data link 172. It should be understood that rotational drive VFD 164, packaging material drive VFD 166, and lift drive VFD 168 may produce outputs to controller 170 that controller 170 may use as indicators of rotational movement.

Controller 170 in the embodiment illustrated in FIG. 2 is a local controller that is physically co-located with the packaging material drive system 120, rotational drive system 136 and lift drive system 142. Controller 170 may include hardware components and/or software program code that allow it to receive, process, and transmit data. It is contemplated that controller 170 may be implemented as a programmable logic controller (PLC), or may otherwise operate similar to a processor in a computer system. Controller 170 may communicate with an operator interface 174 via a data link 176. Operator interface 174 may include a display or screen and controls that provide an operator with a way to monitor, program, and operate wrapping apparatus 100. For example, an operator may use operator interface 174 to enter or change predetermined and/or desired settings and values, or to start, stop, or pause the wrapping cycle. Controller 170 may also communicate with one or more sensors, e.g., sensors 152 and 156, among others, through a data link 178 to allow controller 170 to receive feedback and/or performance-related data during wrapping, such as roller and/or drive rotation speeds, load dimensional data, etc. It is contemplated that data links 162, 172, 176, and 178 may include any suitable wired and/or wireless communications media known in the art.

For the purposes of the invention, controller 170 may represent practically any type of computer, computer system, controller, logic controller, or other programmable electronic device, and may in some embodiments be implemented using one or more networked computers or other electronic devices, whether located locally or remotely with respect to the various drive systems 120, 136 and 142 of wrapping apparatus 100.

Controller 170 typically includes a central processing unit including at least one microprocessor coupled to a memory, which may represent the random access memory (RAM) devices comprising the main storage of controller 170, as well as any supplemental levels of memory, e.g., cache memories, non-volatile or backup memories (e.g., programmable or flash memories), read-only memories, etc. In addition, the memory may be considered to include memory storage physically located elsewhere in controller 170, e.g., any cache memory in a processor in CPU 52, as well as any storage capacity used as a virtual memory, e.g., as stored on a mass storage device or on another computer or electronic device coupled to controller 170. Controller 170 may also include one or more mass storage devices, e.g., a floppy or other removable disk drive, a hard disk drive, a direct access storage device (DASD), an optical drive (e.g., a CD drive, a DVD drive, etc.), and/or a tape drive, among others. Furthermore, controller 170 may include an interface 190 with one or more networks 192 (e.g., a LAN, a WAN, a wireless network, and/or the Internet, among others) to permit the communication of information to the components in wrapping apparatus 100 as well as with other computers and electronic devices, e.g. computers such as a desktop computer or laptop computer 194, mobile devices such as a mobile phone 196 or tablet 198, multi-user computers such as servers or cloud resources, etc. Controller 170 operates under the control of an operating system, kernel and/or firmware and executes or otherwise relies upon various computer software applications, components, programs, objects, modules, data structures, etc. Moreover, various applications, components, programs, objects, modules, etc. may also execute on one or more processors in another computer coupled to controller 170, e.g., in a distributed or client-server computing environment, whereby the processing required to implement the functions of a computer program may be allocated to multiple computers over a network.

In general, the routines executed to implement the embodiments of the invention, whether implemented as part of an operating system or a specific application, component, program, object, module or sequence of instructions, or even a subset thereof, will be referred to herein as "computer program code," or simply "program code." Program code typically comprises one or more instructions that are resident at various times in various memory and storage devices in a computer, and that, when read and executed by one or more processors in a computer, cause that computer to perform the steps necessary to execute steps or elements embodying the various aspects of the invention. Moreover, while the invention has and hereinafter will be described in the context of fully functioning controllers, computers and computer systems, those skilled in the art will appreciate that the various embodiments of the invention are capable of being distributed as a program product in a variety of forms, and that the invention applies equally regardless of the particular type of computer readable media used to actually carry out the distribution.

Such computer readable media may include computer readable storage media and communication media. Computer readable storage media is non-transitory in nature, and may include volatile and non-volatile, and removable and non-removable media implemented in any method or technology for storage of information, such as computer-readable instructions, data structures, program modules or other data. Computer readable storage media may further include RAM, ROM, erasable programmable read-only memory (EPROM), electrically erasable programmable read-only memory (EEPROM), flash memory or other solid state memory technology, CD-ROM, digital versatile disks (DVD), or other optical storage, magnetic cassettes, magnetic tape, magnetic disk storage or other magnetic storage devices, or any other medium that can be used to store the desired information and which can be accessed by controller 170. Communication media may embody computer readable instructions, data structures or other program modules. By way of example, and not limitation, communication media may include wired media such as a wired network or direct-wired connection, and wireless media such as acoustic, RF, infrared and other wireless media. Combinations of any of the above may also be included within the scope of computer readable media.

Various program code described hereinafter may be identified based upon the application within which it is implemented in a specific embodiment of the invention. However, it should be appreciated that any particular program nomenclature that follows is used merely for convenience, and thus the invention should not be limited to use solely in any specific application identified and/or implied by such nomenclature. Furthermore, given the typically endless number of manners in which computer programs may be organized into routines, procedures, methods, modules, objects, and the like, as well as the various manners in which program functionality may be allocated among various software layers that are resident within a typical computer (e.g., operating systems, libraries, API's, applications, applets, etc.), it should be appreciated that the invention is not limited to the specific organization and allocation of program functionality described herein.

In the discussion hereinafter, the hardware and software used to control wrapping apparatus 100 is assumed to be incorporated wholly within components that are local to wrapping apparatus 100 illustrated in FIGS. 1-2, e.g., within components 162-178 described above. It will be appreciated, however, that in other embodiments, at least a portion of the functionality incorporated into a wrapping apparatus may be implemented in hardware and/or software that is external to the aforementioned components. For example, in some embodiments, some user interaction may be performed using a networked computer or mobile device, with the networked computer or mobile device converting user input into control variables that are used to control a wrapping operation. In other embodiments, user interaction may be implemented using a web-type interface, and the conversion of user input may be performed by a server or a local controller for the wrapping apparatus, and thus external to a networked computer or mobile device. In still other embodiments, a central server may be coupled to multiple wrapping stations to control the wrapping of loads at the different stations. As such, the operations of receiving user input, converting the user input into control variables for controlling a wrap operation, initiating and implementing a wrap operation based upon the control variables, providing feedback to a user, etc., may be implemented by various local and/or remote components and combinations thereof in different embodiments. As such, the invention is not limited to the particular allocation of functionality described herein.

Figure 3:
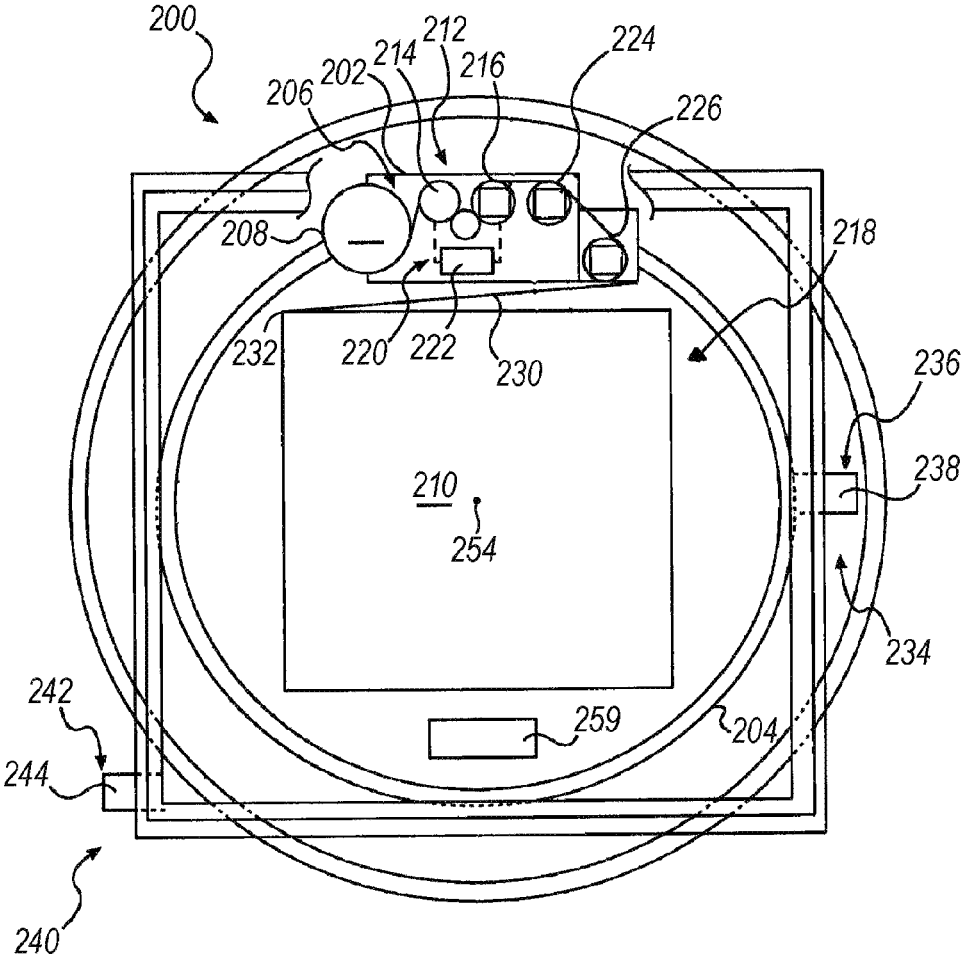
FIG. 3 shows a top view of a rotating ring-type wrapping apparatus consistent with the invention.

Now turning to FIG. 3, a rotating ring-type wrapping apparatus 200 is illustrated. Wrapping apparatus 200 may include elements similar to those shown in relation to wrapping apparatus 100 of FIG. 1, including, for example, a roll carriage or elevator 202 including a packaging material dispenser 206 configured to dispense packaging material 208 during relative rotation between roll carriage 202 and a load 210 disposed on a load support 218. However, a rotating ring 204 is used in wrapping apparatus 200 in place of rotating arm 104 of wrapping apparatus 100. In many other respects, however, wrapping apparatus 200 may operate in a manner similar to that described above with respect to wrapping apparatus 100.

Packaging material dispenser 206 may include a prestretch assembly 212 including an upstream dispensing roller 214 and a downstream dispensing roller 216, and a packaging material drive system 220, including, for example, an electric motor 222, may be used to drive dispensing rollers 214 and 216. Downstream of downstream dispensing roller 216 may be provided one or more idle rollers 224, 226, with the most downstream idle roller 226 effectively providing an exit point 228 from packaging material dispenser 206, such that a portion 230 of packaging material 208 extends between exit point 228 and a contact point 232 where the packaging material engages load 210.

Wrapping apparatus 200 also includes a relative rotation assembly 234 configured to rotate rotating ring 204, and thus, packaging material dispenser 206 mounted thereon, relative to load 210 as load 210 is supported on load support surface 218. Relative rotation assembly 234 may include a rotational drive system 236, including, for example, an electric motor 238. Wrapping apparatus 200 may further include a lift assembly 240, which may be powered by a lift drive system 242, including, for example, an electric motor 244, that may be configured to move rotating ring 204 and roll carriage 202 vertically relative to load 210. In addition, similar to wrapping apparatus 100, wrapping apparatus 200 may include various sensors, as well as additional components used in connection with other aspects of a wrapping operation, e.g., a clamping device 259 may be used to grip the leading end of packaging material 208 between cycles.

Figure 4:
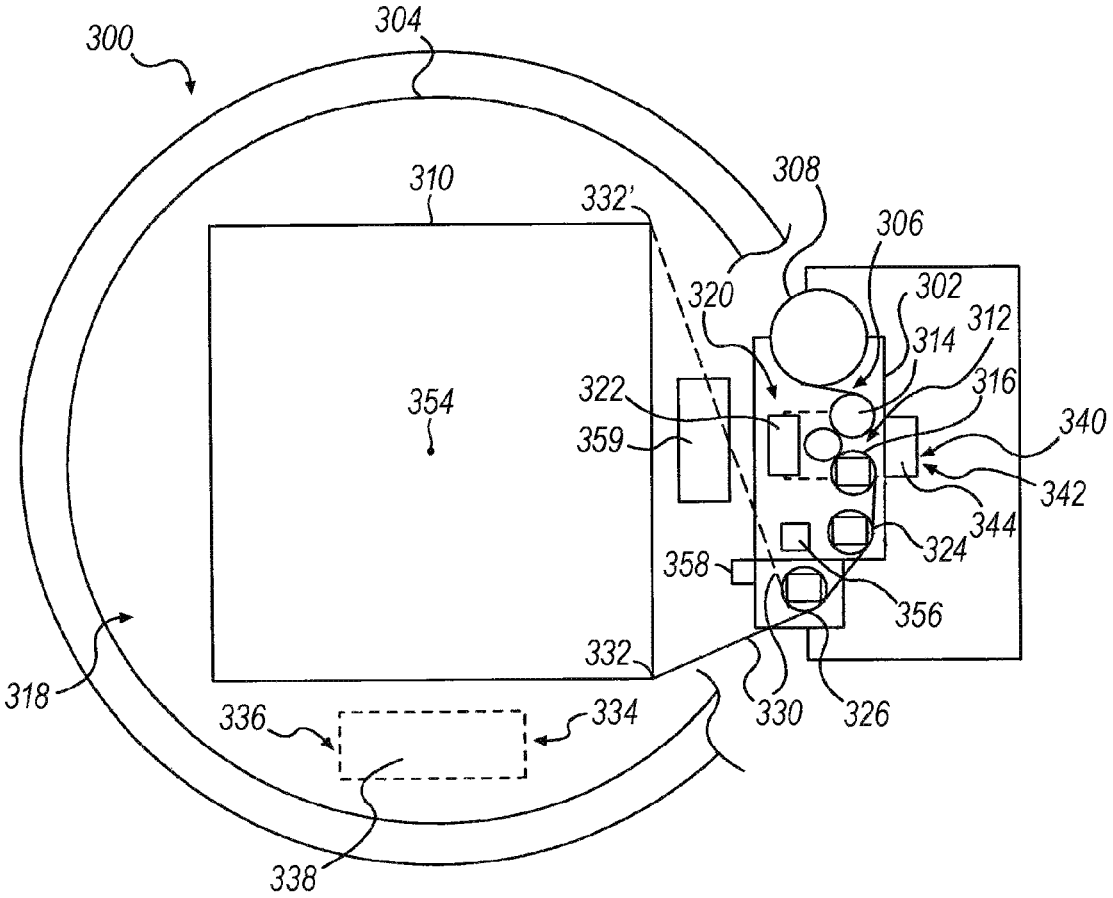
FIG. 4 shows a top view of a turntable-type wrapping apparatus consistent with the invention.

FIG. 4 likewise shows a turntable-type wrapping apparatus 300, which may also include elements similar to those shown in relation to wrapping apparatus 100 of FIG. 1. However, instead of a roll carriage or elevator 102 that rotates around a fixed load 110 using a rotating arm 104, as in FIG. 1, wrapping apparatus 300 includes a rotating turntable 304 functioning as a load support 318 and configured to rotate load 310 about a center of rotation 354 (through which projects an axis of rotation that is perpendicular to the view illustrated in FIG. 4) while a packaging material dispenser 306 disposed on a roll carriage or elevator 302 remains in a fixed location about center of rotation 354 while dispensing packaging material 308. In many other respects, however, wrapping apparatus 300 may operate in a manner similar to that described above with respect to wrapping apparatus 100.

Packaging material dispenser 306 may include a prestretch assembly 312 including an upstream dispensing roller 314 and a downstream dispensing roller 316, and a packaging material drive system 320, including, for example, an electric motor 322, may be used to drive dispensing rollers 314 and 316, and downstream of downstream dispensing roller 316 may be provided one or more idle rollers 324, 326, with the most downstream idle roller 326 effectively providing an exit point 328 from packaging material dispenser 306, such that a portion 330 of packaging material 308 extends between exit point 328 and a contact point 332 (or alternatively contact point 332' if load 310 is rotated in a counter-clockwise direction) where the packaging material engages load 310.

Wrapping apparatus 300 also includes a relative rotation assembly 334 configured to rotate turntable 304, and thus, load 310 supported thereon, relative to packaging material dispenser 306. Relative rotation assembly 334 may include a rotational drive system 336, including, for example, an electric motor 338. Wrapping apparatus 300 may further include a lift assembly 340, which may be powered by a lift drive system 342, including, for example, an electric motor 344, that may be configured to move roll carriage or elevator 302 and packaging material dispenser 306 vertically relative to load 310. In addition, similar to wrapping apparatus 100, wrapping apparatus 300 may include various sensors, as well as additional components used in connection with other aspects of a wrapping operation, e.g., a clamping device 359 may be used to grip the leading end of packaging material 308 between cycles.

Each of wrapping apparatus 200 of FIG. 3 and wrapping apparatus 300 of FIG. 4 may also include a controller (not shown) similar to controller 170 of FIG. 2, and receive signals from one or more of the aforementioned sensors and control packaging material drive system 220, 320 during relative rotation between load 210, 310 and packaging material dispenser 206, 306.

Those skilled in the art will recognize that the example environments illustrated in FIGS. 1-4 are not intended to limit the present invention. Indeed, those skilled in the art will recognize that other alternative environments may be used without departing from the scope of the invention.

Wrapping Operations

During a typical wrapping operation, a clamping device, e.g., as known in the art, is used to position a leading edge of the packaging material on the load such that when relative rotation between the load and the packaging material dispenser is initiated, the packaging material will be dispensed from the packaging material dispenser and wrapped around the load. In addition, where prestretching is used, the packaging material is stretched prior to being conveyed to the load. During a main portion of a wrapping cycle, the dispense rate of the packaging material is controlled during the relative rotation between the load and the packaging material, and a lift assembly controls the position, e.g., the height or elevation, of the web of packaging material engaging the load so that the packaging material is wrapped in a spiral manner around the sides of the load from the base or bottom of the load to the top. Multiple layers of packaging material may be wrapped around the load over multiple passes to increase overall containment force, and once the desired amount of packaging material is dispensed, the packaging material is severed to complete the wrap.

Figure 5:
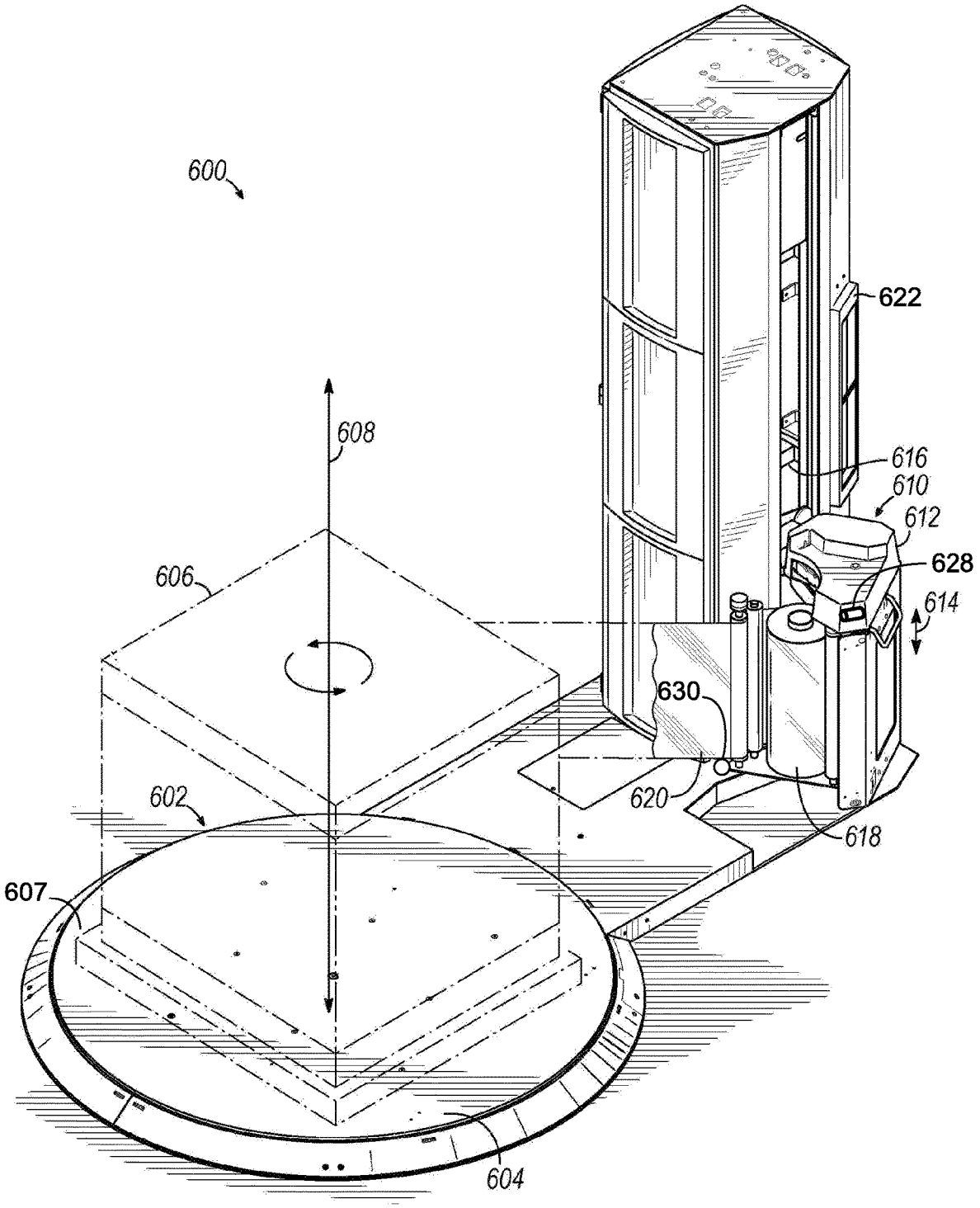
FIG. 5 is a perspective view of a turntable-type wrapping apparatus consistent with the invention.

In addition, as noted above, during a wrapping operation, the position of the web of packaging material may be controlled to wrap the load in a spiral manner. FIG. 5, for example, illustrates a turntable-type wrapping apparatus 600 similar to wrapping apparatus 300 of FIG. 4, including a load support 602 configured as a rotating turntable 604 for supporting a load 606 disposed on a pallet 607. Turntable 604 rotates about an axis of rotation 608, e.g., in a counter-clockwise direction as shown in FIG. 5.

A packaging material dispenser 610 is mounted to a roll carriage or elevator 612 that is configured for movement along an axis 614 by a lift mechanism 616. Packaging material dispenser 610 supports a roll 618 of packaging material, which during a wrapping operation includes a web 620 extending between packaging material dispenser 610 and load 606.

Axis 614 is generally parallel to an axis about which packaging material is wrapped around load 606, e.g., axis 608, and movement of elevator 612, and thus web 620, along axis 614 during a wrapping operation enables packaging material to be wrapped spirally around the load. It will be appreciated, however, that axis 614 need not be parallel to axis 608 in some embodiments, and in such embodiments, a change in elevation of web 620 parallel to axis 608 may represent only a component of the movement of elevator 612 along axis 614 that is parallel to axis 608. It will be appreciated that a roll carriage or elevator, in this regard, may be considered to include any structure on a wrapping machine (e.g., a turntable-type, rotating ring-type or rotating arm-type) that is capable of controllably changing the elevation of a packaging material dispenser coupled thereto, and thereby effectively changing the elevation of a web of packaging material dispensed by the packaging material dispenser.

The position of packaging material dispenser 610 may be sensed using a sensing device (not shown in FIG. 5), which may include any suitable reader, encoder, transducer, detector, or sensor capable of determining the position of the elevator, another portion of the packaging material dispenser, or of the web of packaging material itself relative to load 606 along axis 614. It will be appreciated that while a vertical axis 614 is illustrated in FIG. 5, and thus the position of elevator 612 corresponds to a height, in other embodiments, e.g., where a load is wrapped about an axis other than a vertical axis, the position of the elevator may not be perfectly related to a height. In addition, the height of the load may be sensed using a sensing device 628, e.g., a photoelectric sensor.

Moreover, in the illustrated embodiments discussed hereinafter, axis 608 is vertically oriented such that elevator 612 moves substantially vertically in a direction corresponding to a height dimension of the load. In some embodiments, however, such as in connection with a horizontal ring-type wrapping apparatus, the axis of rotation may not be vertically oriented. As such, while reference may be made hereinafter to directions or positions such as "top," "bottom," "up," "down," "elevation," etc., one of ordinary skill in the art will appreciate that such nomenclature is used merely for convenience, and the invention is not limited to use with a vertical axis of rotation.

Control of the position of elevator 612, as well as of the other drive systems in wrapping apparatus 600, is provided by a controller 622, the details of which are discussed in further detail below.

Top Layer Containment Operation

Top layer containment operations in the embodiments discussed hereinafter generally incorporate bidirectional movement of a web of packaging material, e.g., in directions generally parallel to an axis of rotation, within one or more individual revolutions of a packaging material dispenser relative to a load. As such, top layer containment operations consistent with the invention generally include some degree of control over the elevation of the web, or even control of the elevation of an edge of the web (e.g., a top and/or bottom edge of the web).

As noted above, in some embodiments, for typical spiral wraps, the elevation of a web of packaging material is primarily controlled by controlling the elevation of an elevator upon which a packaging material dispenser is mounted. As such, in some embodiments, the bidirectional movement of the web may be managed solely through control over the movement of an elevator or other mechanism that controls the elevation of a packaging material dispenser, or at least an exit point of a packaging material dispenser (i.e., the last point of contact between a packaging material dispenser and the web of packaging material). In some embodiments, it may also be desirable to use a higher speed elevator drive system (e.g., by utilizing a higher horsepower elevator drive motor) to reduce travel times between different elevations of the packaging material dispenser.

In other embodiments, however, control over the elevation of a web may be supplemented by the use of a roping mechanism, e.g., roping mechanism 630 of FIG. 5, which is configured to form a rope of packaging material along a bottom edge of the web. "Roping" generally refers to gathering and/or rolling an edge of a web of packaging material inwardly, typically through moving the edge of the film over a wheel or bar disposed in the path of the web. Roping is often used along a bottom edge of a web to enable a rope of packaging material to be wrapped around a pallet to assist with securing a load to the pallet, although roping may also be used to form a rope that is wrapped around other portions of a load. Furthermore, roping may also be used on the top edge of a web, and in some instances, roping may be performed on both edges of a web.

Irrespective of the manner in which a rope is formed on a web, an inherent result of roping is that the width of the web exiting a packaging material dispenser is reduced. In addition, the elevation of the roped edge is changed, and as such, roping may also be used to control the elevation of a web of packaging material. Roping may fully narrow the width of a web into a rope, or may partially narrow the width of the web such that a rope is formed on one or both edges of the web, but with the remainder of the width of the web remaining substantially flat.

Figure 6A:
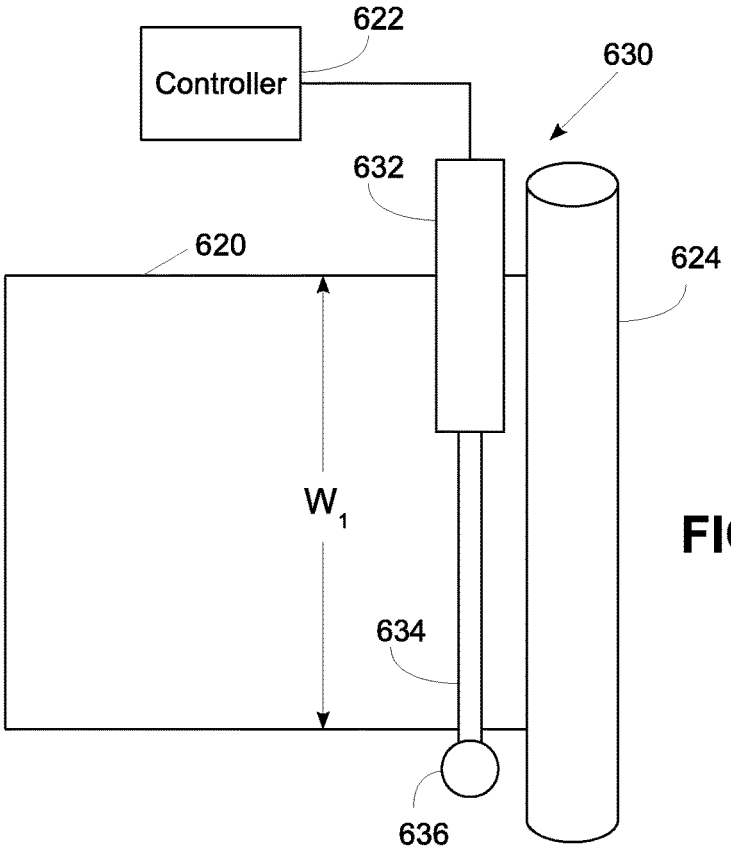
FIGS. 6A and 6B are functional views illustrating a drive up roping mechanism in disengaged (FIG. 6A) and engaged (FIG. 6B) positions.
Figure 6B:
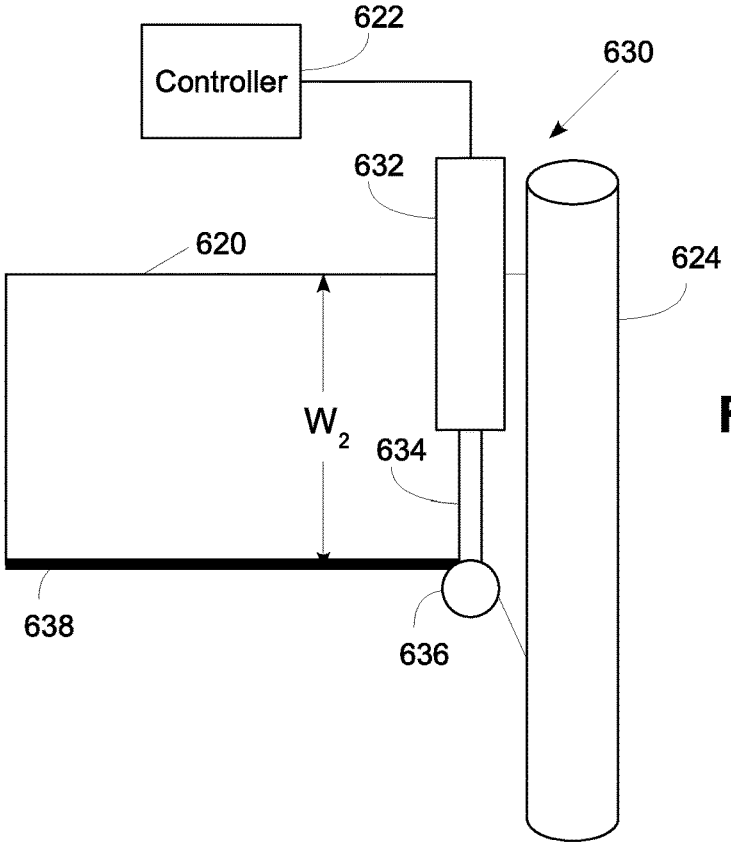

FIGS. 6A-6B, for example, illustrate an example implementation of roping mechanism 630 consistent with some embodiments of the invention. Roping mechanism 630, for example, may be disposed downstream of an idle roller 624 of packaging material dispenser 610. In this embodiment, idle roller 624 acts as the exit point of the packaging material dispenser 610, and roping mechanism 630 operates to form a rope along a bottom edge of web 620.

Roping mechanism 630 may include, for example, a linear actuator 632 having a piston 634 that is movable in a direction generally perpendicular to the edges of web 620. A bar or roller 636 may be disposed on piston 634 to selectively engage with the bottom edge of web 620, and linear actuator 632 may be in communication with controller 622 to enable controller 622 to selectively extend or retract piston 634. In a first, extended position, such as is illustrated in FIG. 6A, bar or roller 636 is positioned outside of the path of web 620 such that web 620 has a width $W_1$. As illustrated in FIG. 6B, actuation of linear actuator 632 by controller 622 may retract piston 634 such that bar or roller 636 is positioned within the path of web 620 to selectively narrow web 620 to a width $W_2$ and thereby form a rope 638 on the bottom edge of the web. As will become more apparent below, the narrowing of web 620 also has the effect of raising the effective height of the bottom edge of the web. As such, roping mechanism 630 may be considered to operate as a "drive up" roping mechanism due to the fact that, when engaged, the roping mechanism drives the bottom edge of the web upwardly relative to the elevation of the web when the roping mechanism is not engaged.

Figure 7A:
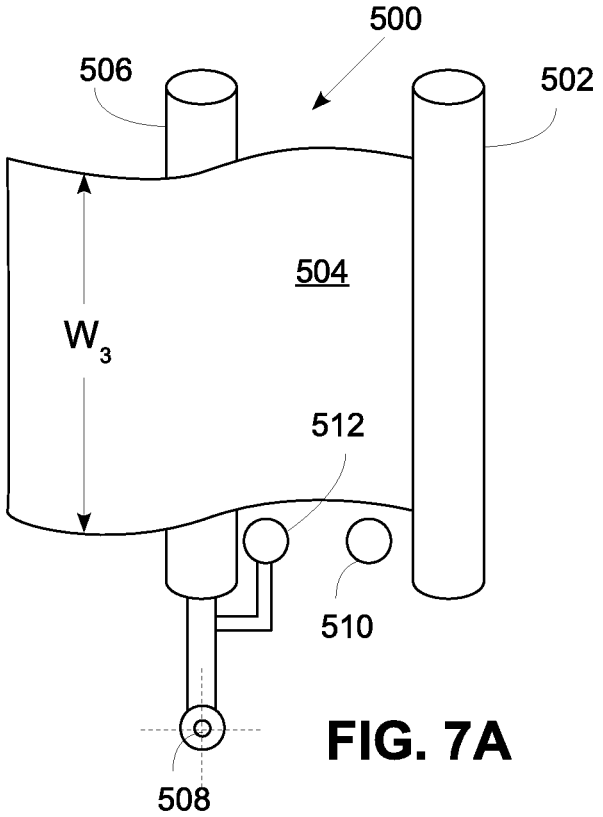
FIGS. 7A and 7B are functional views illustrating a drive down roping mechanism in disengaged (FIG. 7A) and engaged (FIG. 7B) positions.
Figure 7B:
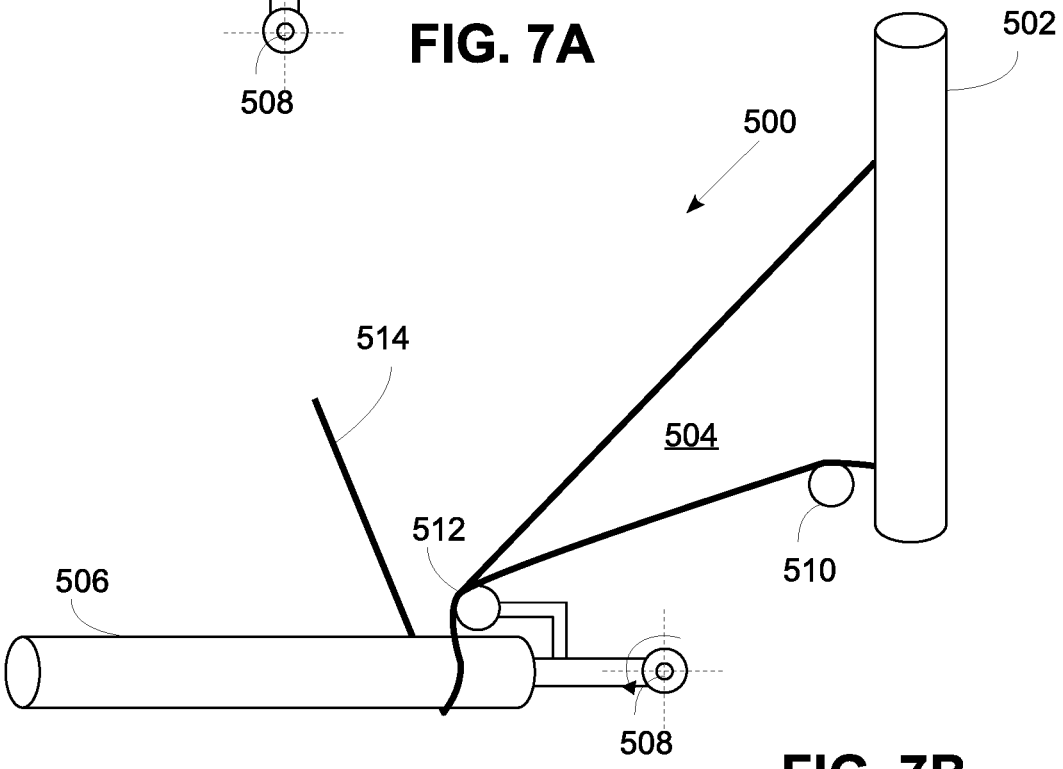

FIGS. 7A-7B, as another example, illustrate an implementation of a drive down roping mechanism 500 consistent with some other embodiments of the invention. Roping mechanism 500, for example, may be disposed downstream of an idle roller 502 of a packaging material dispenser to selectively drive down a web 504 of packaging material. Roping mechanism 500 may include, for example, a roller 506 mounted about a pivot axis 508 that is pivotable from a substantially upright and disengaged position as illustrated in FIG. 7A to an engaged position as illustrated in FIG. 7B. A first fixed bar or roller 510 may be disposed proximate idle roller 502 while a second bar or roller 512 may be mounted for pivotable movement with roller 506, with both bars/rollers 510, 512 configured to selectively engage with the bottom edge of web 504. In a first, upright position, such as is illustrated in FIG. 7A, bars/rollers 510, 512 are positioned outside of the path of web 504 such that web 620 has a width $W_3$. As illustrated in FIG. 7B, pivoting of roller 506 (e.g., using a rotary actuator, piston, linear actuator, etc.) may drive down web 504 to a lower elevation relative to the unengaged position, and bars/rollers 510, 512 may be positioned within the path of web 504 to selectively narrow web 504 to lesser width. In this example implementation, the full width of web 504 is collapsed into a rope 514, although in other implementations, the web may be narrowed to reduced width with a rope formed only on the bottom edge of the web.

Various roping mechanism designs may be used in different embodiments consistent with the invention. For example, linear actuator 632 of FIGS. 6A-6B may be implemented as a hydraulic or air cylinder that is selectively extended through fluid pressure, or may be extended through the use of a solenoid, a screw drive, or in other manners that will be appreciated by those of ordinary skill in the art having the benefit of the instant disclosure. In addition, in some embodiments, other mechanical movements may be used to selectively narrow a web with a bar or roller, e.g., using various combinations of linear and/or rotational movement. In still other embodiments, the top edge or both the top and bottom edges of the web may be displaced to narrow the width of the web. Further, in some embodiments, a roping mechanism may have only fully engaged and fully disengaged positions, while in some embodiments, a roping mechanism may be controllable to narrow the width of a web of packaging material a variable amount. Examples of roping techniques that may be implemented in various embodiments consistent with the invention are disclosed, for example, in U.S. Pat. No. 7,568,327 to Lancaster et al., which is incorporated by reference herein. In one embodiment, for example, the roping mechanism may also include a downwardly-extending wheel that engages a floor or other bottom surface when the packaging material dispenser is positioned at a bottom elevation to automatically form a rope when wrapping packaging material around a pallet.

In addition, in some embodiments, the elevation of an edge of a web may be controlled in part by varying an orientation of the web. For example, for typical wrapping operations, the rollers of a packaging material dispenser generally rotate about axes parallel to the axis of rotation through which relative rotation occurs between the packaging material dispenser and the load, such that the web of packaging material is generally dispensed from the packaging material dispenser in a plane that is likewise parallel to the axis of rotation. In some embodiments, however, it may be desirable to tilt the web of packaging material to a non-parallel orientation (e.g., using a tiltable roller) and thereby alter the elevation of one or both edges of the web. Further, in some embodiments a web may be partially driven up or driven down to vary the elevation of the web relative to that of an elevator. The tilting from a plane substantially parallel to the axis of rotation to a non-parallel plane may include, for example, tilting from a substantially vertical plane to a substantially horizontal plane, or to some intermediate angle relative to the axis of rotation. However, it will be appreciated that it may be desirable in some embodiments to maintain the web with substantially the same amount of tilt throughout a top layer containment operation, e.g., by maintaining the web in substantially the same planar orientation, maintaining the web in an orientation that is substantially parallel to the axis of rotation and/or maintaining the web in a substantially vertical orientation.

Regardless of how the elevation of the web is controlled, it may be desirable in some embodiments to provide a capability to change the elevation of the web a distance of at least about the width of the web within a quarter revolution (e.g., within about 90 degrees of relative rotation). This rate of change may be based upon a reduced rotation speed, or in some embodiments, may be based on the same rotation speed used during a main portion of a typical wrapping operation.

Furthermore, it will be appreciated that roping and/or otherwise narrowing of a web during a top layer containment operation may be beneficial in some applications, while in other applications, maintaining a web substantially "open" (i.e., where no roping and/or controlled narrowing of the web, other than that which may naturally occur as a result of tension in the web, is used to change the elevation of an edge of the web) throughout a top layer containment operation may prove beneficial. Maintaining an open web throughout a top layer containment operation, for example, generally provides greater coverage over the top surface(s) of a load, and may be useful for protecting portions of a load from dust, moisture, etc. Moreover, the greater coverage over the top surface(s) of the load may assist in containing multiple and/or smaller articles in an incomplete top layer and/or a load with a ragged topography due to the greater surface area of the packaging material overlaying and/or contacting the top surface(s) of the load. In contrast, a fully roped web generally covers less surface area of a load's top surface, thereby leaving a greater surface area of the load exposed to the elements, and where an incomplete top layer of a load includes multiple, smaller articles, a risk may exist that a fully roped web may not contact one or more of the articles and may therefore not adequately secure those articles in the wrapped load. In addition, in some applications where the top layer of a load is easily deformable, it may be desirable to maintain an open web to more evenly distribute the wrap forces applied to the load proximate the top of the load. Nonetheless, for various functional and/or aesthetic reasons, roping and/or controlled narrowing of a web may be desirable in some applications when some of the aforementioned concerns are not at issue.

In addition, in some applications it may be desirable for functional and/or aesthetic concerns to utilize a combination of an open web, a fully roped web and/or a partially narrowed web at different points of a top layer containment operation. For example, in some embodiments, it may be desirable to utilize an open web for a majority of top layer containment operations and/or portions of a top layer containment operation, and then only selectively activate roping and/or controlled narrowing of a web in special applications. It may also be desirable in some applications to utilize only a combination of fully open and partially narrowed webs, i.e., where no portion of a web involved in a top layer containment operation is fully roped. Further, it will be appreciated that even if no roping and/or controlled narrowing of a web is not used in a top layer containment operation, roping and/or controlled narrowing may nonetheless still be used in other portions of a wrap cycle, e.g., when securing a bottom layer of a load to a pallet.

It will be appreciated that other mechanisms may be used to control the elevation of a web and/or an edge of the web in other embodiments. The invention is therefore not limited to the web elevation control mechanisms discussed herein.

Figure 8:
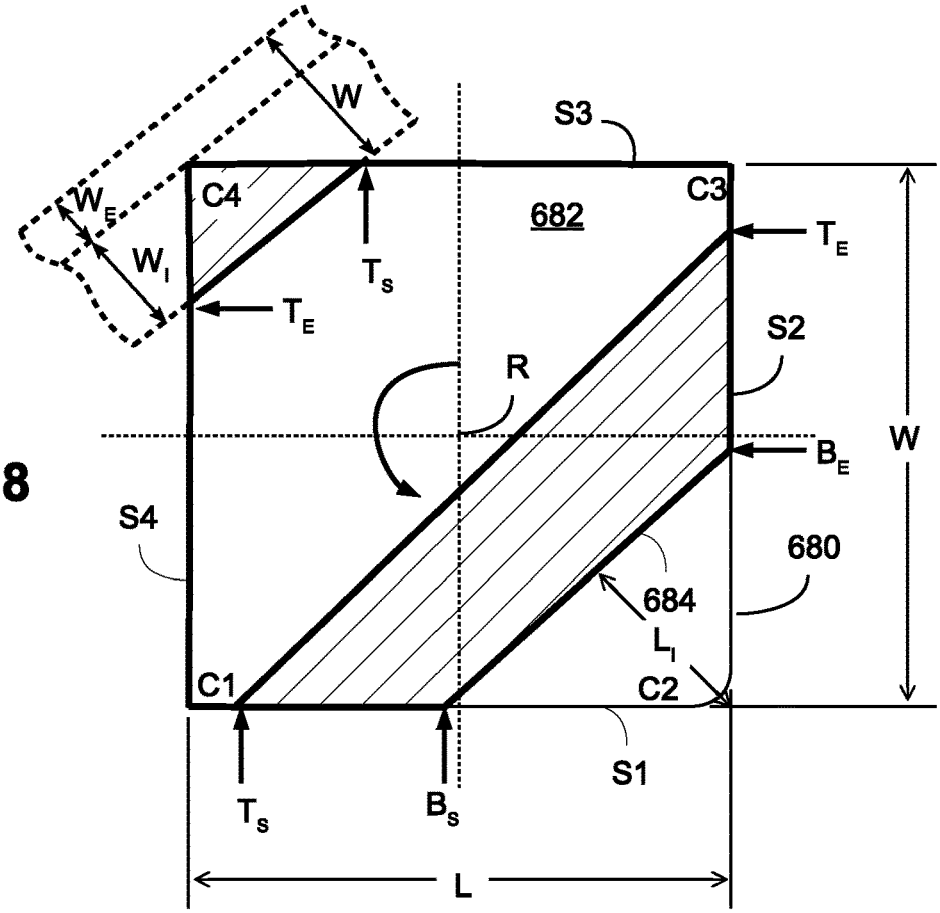
FIG. 8 illustrates a functional top plan view of an example load illustrating various dimensions controlling the engagement of a web of packaging material on a top surface of such example load.
Figure 9:
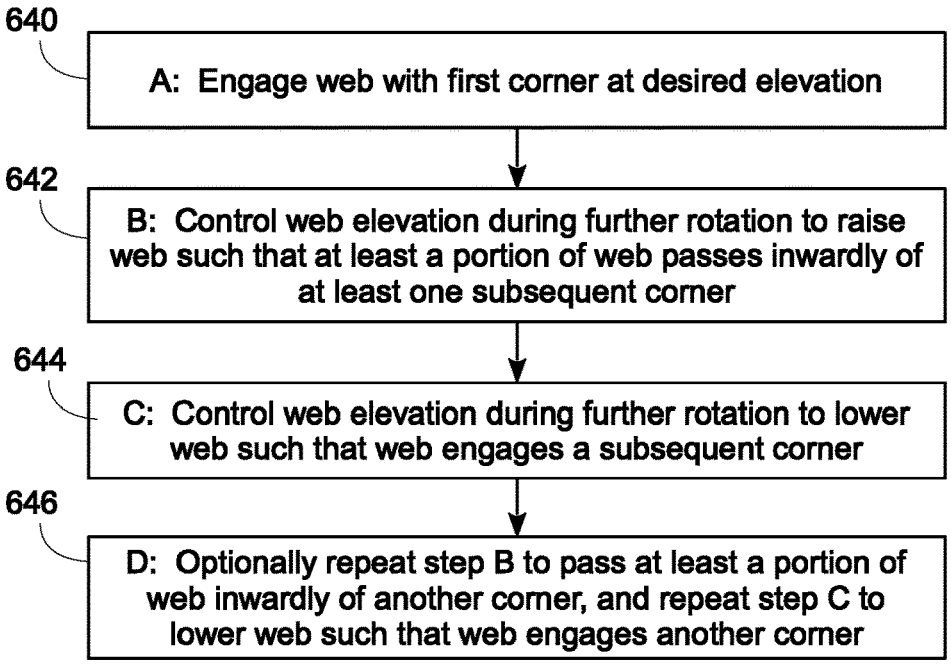
FIG. 9 is a flowchart illustrating a sequence of operations for an example top layer containment operation consistent with the invention.

Now turning to FIGS. 8-9, an example top layer containment operation consistent with the invention is illustrated. A top layer containment operation may include the application of packaging material to a load over the course of one or more revolutions of relative rotation between a load and a packaging material dispenser, and used to address a containment issue generally associated with a top layer of the load (although it will be appreciated that such operations may also find use in connection with standard, cuboid loads in some embodiments). In this regard, a revolution may be considered to be about 360 degrees of relative rotation between a load and a packaging material dispenser, and a top layer containment operation may be considered to constitute one or more revolutions. Within a revolution, a web of packaging material may generally engage one or more corners of a load, while passing at least partially inwardly of one or more other corners of the load.

A corner, within the context of the disclosure, is generally used to refer to an area of a portion of a load, e.g., a main body or pallet, proximate the intersection of two adjacent sides and a top surface of the portion of the load. It will be appreciated that a corner may come to a single point on some loads, while in other loads, a corner may be rounded and thus may not be sharply defined, and may instead refer to a relatively larger area proximate the sides and top surface. As an example, where a load consists of stacked trays of beverage containers, a corner may be defined proximate the cap of an outermost beverage container in an outermost tray in the top layer of the load. As another example, where a load consists of uncartoned packages of paper towels, a corner may be defined proximate the top of an outermost paper towel roll in an outermost package in the top layer of the load.

A top surface may refer to any upwardly-facing surface (when a vertical axis of rotation is used) on a portion of a load, including on a pallet, a main body of a load, an inboard portion of a load, etc. As will become more apparent below, a top surface may be substantially flat over an entire load in some embodiments, while in other embodiments a top surface may have a "ragged" topography that varies in elevation at different points along the top surface, e.g., due to the presence of an inboard portion such as an incomplete layer including one or more boxes, cartons, packages, products, etc. stacked on top of a main body of a load.

FIG. 8, for example, illustrates a top plan view of a load 680 including a top surface 682, four sides S1-S4 and four corners C1-C4. It should be noted that corner C2 is rounded, and further, that top surface 682 is substantially flat in this example. Corner C1 is disposed proximate the intersection or junction of top surface 682 and sides S1 and S4, corner C2 is disposed proximate the intersection or junction of top surface 682 and sides S1 and S2, corner C3 is disposed proximate the intersection or junction of top surface 682 and sides S2 and S3, and corner C4 is disposed proximate the intersection or junction of top surface 682 and sides S3 and S4.

In addition, for the purposes of this disclosure, corners C1 and C3 are considered to form a pair of opposing corners, as are corners C2 and C4, by virtue of their approximately 180 degree separation around the load. Furthermore, from the perspective of counter-clockwise rotation of a web of packaging material around the load about an axis of rotation R, corners C1, C2, C3 and C4 are considered to be sequentially arranged, with corner C2 being immediately subsequent to corner C1, corner C3 being immediately subsequent to corner C2, corner C4 being immediately subsequent to corner C3, and corner C1 being immediately subsequent to corner C4.

A web may be considered to engage a corner when at least a portion of the web wraps around the two adjacent sides proximate the corner. In some embodiments, only a portion of the width of the web may wrap around and contact the two adjacent sides, while in other embodiments, the entire width of the web may do so. Furthermore, in some embodiments, the top edge of the web may have an elevation that is downwardly offset from that of the top surface associated with the corner such that the entire width of the web is at a lower elevation than the top surface.

A web is likewise considered to at least partially pass inwardly of a corner when at least a portion of the width of the web extends over and/or contacts a top surface of the load at a radial distance from the axis of rotation that is less than that of the corner. A web may be considered to entirely pass inwardly of a corner when the entire width of the web, and as such, both edges of the web, are radially inward of the corner. In addition, in some embodiments, a web may be considered to partially pass inwardly of a corner when only a majority of the width of the web, and thus only one edge thereof, is radially inward of the corner. A majority may be considered to be greater than about 50% in some embodiments, and in some embodiments, about 75% or more of the width of a web may pass inwardly of a corner. In addition, in some embodiments, when a web passes inwardly of a corner, the web is considered to have "avoided" the corner due to the fact that the full width of the web is not wrapped around the adjoining sides of the corner.

As noted above, a top layer containment operation may include one or more revolutions of packaging material about a load wherein, within a revolution, a web of packaging material may generally engage one or more corners of a load, while at least partially passing inwardly of one or more other corners of the load. FIG. 9, for example, illustrates in blocks 640-646 a sequence of operations (steps A-D) that may be performed within a revolution of a top layer containment operation in some embodiments of the invention. In step A (block 640), the web may engage a first corner of the load at a desired elevation, and then, in step B (block 642), the elevation of the web may be controlled during further rotation after engagement of the first corner to raise the elevation of the web such that at least a portion of the web passes inwardly of at least one subsequent corner of the load. Then, in step C (block 644), the elevation of the web may be controlled during further rotation after passing inwardly of a corner to lower the elevation of the web such that the web engages a subsequent corner of the load. In addition, in a further optional step D (block 646), step B, and in some instances, step C may be repeated to pass the web inwardly of another corner and/or engage another corner.

In addition, as will become more apparent below, steps A-D may also be repeated during subsequent revolutions, and that individual revolutions may be separated by some relative rotation such that different revolutions start at different corners (i.e., revolutions are not required to all begin at the same rotational angle). Further, by combining multiple revolutions, various wrapping "patterns" may be generated to contain a top layer of a load. Several types of wrapping patterns, e.g., wrap patterns referred to hereinafter as "U wrap," "cross wrap", etc., may be used in different applications to improve the containment of a load with packaging material.

Returning to FIG. 8, for example, this figure illustrates one revolution of a cross wrap pattern for a packaging material web 684, starting at corner C1. In this example, corner C1 is engaged by web 684, and after further rotation, the elevation of the web is raised sufficiently such that the entire width of the web passes inwardly of corner C2. Thereafter, the elevation of the web is lowered such that the web engages corner C3. The elevation of the web is then raised to a position where only a portion of the width of the web passes inwardly of corner C4, and after further rotation, the web is maintained at an elevation to complete the revolution with the web once again engaging corner C1. With respect to corner C4, the full width $W_T$ of web 684 is illustrated in broken lines, with a majority of the width, labeled $W_I$, passing inwardly of corner C4, and the remainder of the width, labeled $W_E$, engaging the corner C4.

As will become more apparent below, the positioning of a web of packaging material may be controlled in a number of manners and based upon a number of factors for functional and/or aesthetic concerns. It may be desirable, for example, to control where a web of packaging material engages a corner, a start point where the web wraps over an edge between a side of the load and the top surface prior to passing inwardly of a corner, how far and/or how much of the web passes inwardly of a corner and/or an end point where the web wraps over an edge between the top surface and a side of the load after the web passes inwardly of a corner. For example, as illustrated in FIG. 8, for the portion of web 684 that passes entirely inwardly of corner C2, it may be desirable to control a start point of a top edge of the web ($T_S$), a start point of a bottom edge of the web ($B_S$), an end point of a top edge of the web ($T_E$), an end point of a bottom edge of the web ($B_E$) and/or a length $L_I$ that the web is inward of corner C2. Likewise, for the portion of web 684 that passes partially inwardly of corner C4, it may be desirable to control a start point of a top edge of the web ($T_S$), an end point of a top edge of the web ($T_E$), a portion of the width of the web that is inward of corner C4 ($W_I$) and/or a portion of the width of the web that engages corner C4 ($W_E$). The start and/or end points, of note, may be measured from preceding and/or subsequent corners, and may be based at least on part of the dimensions (e.g., length or width) of the load.

Control of the elevation of a web to position the web in the desired position(s) may be based upon the elevation of the web, the rate of change of the elevation of the web (e.g., the speed of an elevator), the timing of when changes in the elevation of the web occur, and/or the separation between corners (e.g., based upon the length (L) and/or width (W) of the load and/or any offset in the load from a center of rotation). For example, the timing may be based upon a sensed rotational angle between a packaging material dispenser and a load, or in some embodiments, may be based upon a timer that is triggered at a known rotational position (e.g., a home rotational position) and that is based upon a known rate of rotation (e.g., in RPM). If it is known, for example, that if a rate of rotation is 30 RPM, one revolution takes 60/30=2 seconds to complete, so adjacent corners are separated temporally by 500 milliseconds, and the start and/or end points between two corners will thus be reached within some determinable fraction of this amount. Further, trigonometric principles may be applied to determine, based the elevation of the web after engaging a corner and the desired point of contact between adjacent corners, what the elevation of the web needs to be and when the web needs to reach the desired elevation. In other instances, the timing and/or elevations may be determined empirically for various types of loads.

It will be appreciated that due to the tackiness of packaging material, a portion of a web that engages a corner will generally adhere to the corner and retain the elevation and angle at which it was applied. Likewise, a portion of a web that wraps over an edge between a side and the top surface of the load will also generally adhere to the side of the load and thereby retain the same elevation and angle at which it was applied. As such, control over the elevation of the web at each of these points of contact with the corner and the edge (as well as corresponding control of the elevation when returning to engage a subsequent corner) may be used to pass the web inwardly of the subsequent corner to a controlled amount.

Control of the elevation of the web, as noted above, may be based upon movement of an elevator or carriage supporting at least a portion of a packaging material dispenser, engagement of a roping mechanism to narrow the web from the top and/or bottom edge, changing the orientation of the web, and other manners that would be apparent to one of ordinary skill in the art having the benefit of the instant disclosure. Further, the control may be used for functional purposes, e.g., to contain a particular size or type of inboard load or top surface topography, as well as for aesthetic purposes, e.g., to provide a symmetrical wrapping pattern around all four sides of the load.

Further, in some embodiments it may also be desirable to control a wrap force or tension applied to a web of packaging material during a top layer containment operation to optimize containment and reduce the risk of packaging material breaks. For example, it should be appreciated that when a web is increasing in elevation in conjunction with relative rotation, the effective demand of the load increases above the demand during the main portion of a wrapping cycle, and as such, decreasing the wrap force or tension applied to the web of packaging material during an elevation increase in association with passing inwardly of a corner may offset the increased demand. Likewise, increasing the wrap force or tension applied to the web of packaging material during an elevation decrease after passing inwardly of a corner may offset a decrease in demand occurring due to the lowering of the elevation of the web. In some embodiments, for example, it may be desirable to temporarily increase and/or decrease a wrap force relative to a wrap force parameter that is used to control the wrap force during the main portion of a wrapping cycle. It will also be appreciated that control over a wrap force or tension may also be handled by changing a dispense rate of a packaging material dispenser, as dispense rate is generally inversely proportional to the tension in a web of packaging material during a wrapping operation.

In one example embodiment, for example, a wrap sequence for a top layer containment operation may be implemented using a plurality of timers and associated elevations (e.g., relative to a height of a main body of a load). Each timer may be trigged relative to a home position and has a time value corresponding to an angular position during the rotation at which to command the elevator of the packaging material dispenser to move to the associated elevation. The timers may be determined, for example, based upon input or sensed cross-sectional dimensions (e.g., length, width) of the load. In addition, in some instances, timers for subsequent rotations may be triggered relative to a home position of a previous rotation to enable a movement of the elevator to a new elevation to begin prior to reaching the home position. Further, in some embodiments, timers may be adjusted based upon whether a load is known or detected to be conveyed with a short or long side first, e.g., as may be the case for loads disposed on standard 40×48 pallets.

In addition, in some embodiments, it may be desirable to apply a rotational data shift to account for system lags inherent in a wrapping apparatus, e.g., due to electrical and physical delays in sensors, drive motors, control circuitry and even the packaging material itself. System lags may result in the effects of control signals that drive the dispense rate, elevation, roping, tilt, or other parameters associated with a top layer containment operation not physically occurring at the load until after some duration of time or further angular rotation. As such, to address this issue, it may be desirable to adjust a relative timing of one or more control signals by a predetermined amount of time or rotational position such that the results of applying the one or more control signals occur closer to a calculated time or rotational position.

In some embodiments, the system lag from which the rotational shift may be calculated may be a fixed value determined empirically for a particular wrapping apparatus. In other embodiments, the system lag may have both fixed and variable components, and as such, may be derived based upon one or more operating conditions of the wrapping apparatus. For example, a controller will typically have a fairly repeatable electronic delay associated with computational and communication costs, which may be assumed in many instances to be a fixed delay. In contrast, the rotational inertia of packaging material dispenser components, different packaging material thicknesses and compositions, and the wrapping speed (e.g., in terms of revolutions per minute of the load) may contribute variable delays depending upon the current operating condition of a wrapping apparatus. As such, in some embodiments, the system lag may be empirically determined or may be calculated as a function of one or more operating characteristics.

Thus, for example, if it is determined that the elevation of the dispenser should be at a predetermined height at a predetermined rotational angle or a predetermined amount of time after the home position, a rotational shift may be applied to cause the control signal that drives the elevator to be asserted at an earlier rotational angle or a shorted time to compensate for the system lag.

Further, in some embodiments, the rotational or angular locations of corners may be detected during one or more relative revolutions and a fixed or variable rotational shift may be applied to those detected locations. As such, rather than adjusting the timing of the assertion of the control signals, the relative locations of the corners against which those control signals are timed may be adjusted.

Rotational shifts may also be applied in other manners consistent with the invention. For example, through positioning of a sensor such as a load distance sensor at an earlier rotational position, e.g., shifted a few degrees in advance of a base or home position, the sensor data may be treated as if it were collected at the base or home position to apply a rotational shift to the model.

Various specific applications of top layer containment operations are discussed hereinafter. Various modifications to these applications will be apparent to one of ordinary skill in the art and as such the invention is not limited to these particular applications.

Securing Inboard Product

As noted above, order pick pallet loads often end up with a partial top layer of product, including in some instances only one case of product on the top. Securement of these partial top layers in an automatic cycle without the addition of manual manipulation of roped packaging material by operators can be difficult to achieve. A similar problem may exist when products stacked on a pallet are much smaller than the pallet itself. It has been found that many conventional wrapping techniques have difficulty when a partial top layer or a product on a pallet is more than about 3" inboard of the corners of the main body of the load or the pallet. For the purposes of this disclosure, a partial top layer of product or a product that is substantially inboard of a pallet will be referred to herein as an inboard portion of a load, whereas the main body of a load or the pallet will be referred to herein as a supporting body, i.e., the body upon which the inboard portion of the load is supported during wrapping. An inboard portion in some embodiments, for example, may have a footprint that is inboard at least 3 inches diagonally from any corner of a main body or pallet supporting the inboard portion.

With conventional wrapping techniques, as the elevator and packaging material dispenser travel up from the top of the main body of the load the web of packaging material may transition partially above the main body, leaving flaps of packaging material that cannot reach and secure a partial top layer to the main body of the load. If the web goes above the main body of the load and wraps the partial top layer, and then returns to the main body it generally does not adequately secure the partial top layer to the load, and a risk exists that packaging material breaks may occur as the bottom edge of the packaging material snags the first corner of the main body of the load on the way back down. Similarly, when a load is much smaller than the pallet, conventional wrapping techniques lead to packaging material breaks on the corner of the pallet or to the packaging material failing to reach the load until the packaging material dispenser continues to raise beyond the pallet. Some operators attempt to address these problems through hand manipulation of the web, a solution that is not available in all applications (e.g., with automatic-type machines where operator access is restricted during a wrap operation), and even where available, is both inefficient (due to the need for the operator to manually tend to a wrapping operation when the operator could be performing other activities) and inconsistent (as the manual manipulation will generally vary both between different operators as well as between different loads due to the manual nature of the activity).

Hand manipulation of a web, when used, also tends to increase the time required to wrap a load due to the fact that an operator generally is required to manually adjust a wrapping machine to hold the elevator at a fixed position and slow the rate of relative rotation. The operator then must manually form the web into a rope and raise and lower the web at appropriate times such that the fully roped web contacts individual articles in the partial top layer, and once finished, manually adjust the wrapping machine to restart movement of the elevator and restore the rate of relative rotation. In addition, hand manipulation necessarily requires that the web be fully roped or substantially narrowed in width as a result of grasping the web.

Embodiments consistent with the invention, in contrast, may utilize a top layer containment operation to control an elevation of a web of packaging material to secure an inboard portion of a load to a supporting body such as a main body of the load or a pallet, and without any manual manipulation of the web by an operator. In some embodiments, for example, an inboard portion of the load may be secured to a supporting body within a revolution between the load and a packaging material dispenser by wrapping packaging material around a first corner of the supporting body while controlling the elevation of the web to engage the first corner of the supporting body of the load with a bottom edge of the web, then, after wrapping the packaging material around the first corner of the supporting body, wrapping packaging material around the inboard portion of the load on a side of the load opposite the first corner of the supporting body while controlling the elevation of the web to engage the inboard portion of the load with the bottom edge of the web, and after wrapping the packaging material around the inboard portion of the load, wrapping packaging material around at least one corner of the supporting body while controlling the elevation of the web to engage the supporting body with the bottom edge of the web.

In some embodiments, as will be described in greater detail below, an inboard portion of a load may be secured to a supporting body within a revolution between the load and a packaging material dispenser by bidirectionally changing an elevation of a web of packaging material generally parallel to an axis of rotation during the revolution to engage a bottom edge of a web with the supporting body around each of first and second corners and to engage the bottom edge of the web with the inboard portion of the load around a second, opposite side of the load relative to one or both of the first and second corners.

Also, in some embodiments, an inboard portion of a load may be secured to a supporting body within a revolution between the load and a packaging material dispenser by bidirectionally changing an elevation of a web of packaging material generally parallel to an axis of rotation during the revolution to engage a bottom edge of the web with the supporting body around a corner at a beginning and an end of the revolution and to engage the bottom edge of the web with the inboard portion of the load around a second, opposite side of the load relative to the corner.

Further, in some embodiments, during each of a plurality of revolutions, the elevation of a web of packaging material may be controlled to wrap packaging material around at least one corner of a supporting body across at least a portion of a width of the web and to wrap packaging material around at least one quadrant of an inboard portion of a load that is associated with a different corner from the at least one corner with a bottom edge of the web positioned at a higher elevation than the supporting body.

In other embodiments, the width of a web of packaging material may be controlled between first and second widths, where the second width is narrower than the first width, and a corner of a load or a pallet upon which the load is supported may be avoided or passed inwardly during relative rotation by controlling the width of the web to narrow the web to the second width prior to contact of the web with the corner when the controlled elevation of the web is such that the web would contact the corner if the controlled width of the web is the first width.

In one embodiment, for example, and as illustrated in FIGS. 10-15, a wrapping operation may include a control sequence utilizing three web elevations (H1-H3) in conjunction with four rotational angles (A1-A4) relative to load corners (C1-C4) to enable packaging material to engage at least one corner of a supporting body (e.g., a pallet or a main body of a load) and at least one corner or quadrant of an inboard portion of a load. This process may be repeated to secure at least two corners of the supporting body to at least two corners or quadrants of the inboard portion of the load. In addition, as will become more apparent below, these controls may be used in conjunction with a roping mechanism to facilitate a bottom edge of the web of packaging material avoiding or passing inwardly of at least one corner of the supporting body.

Figure 10:
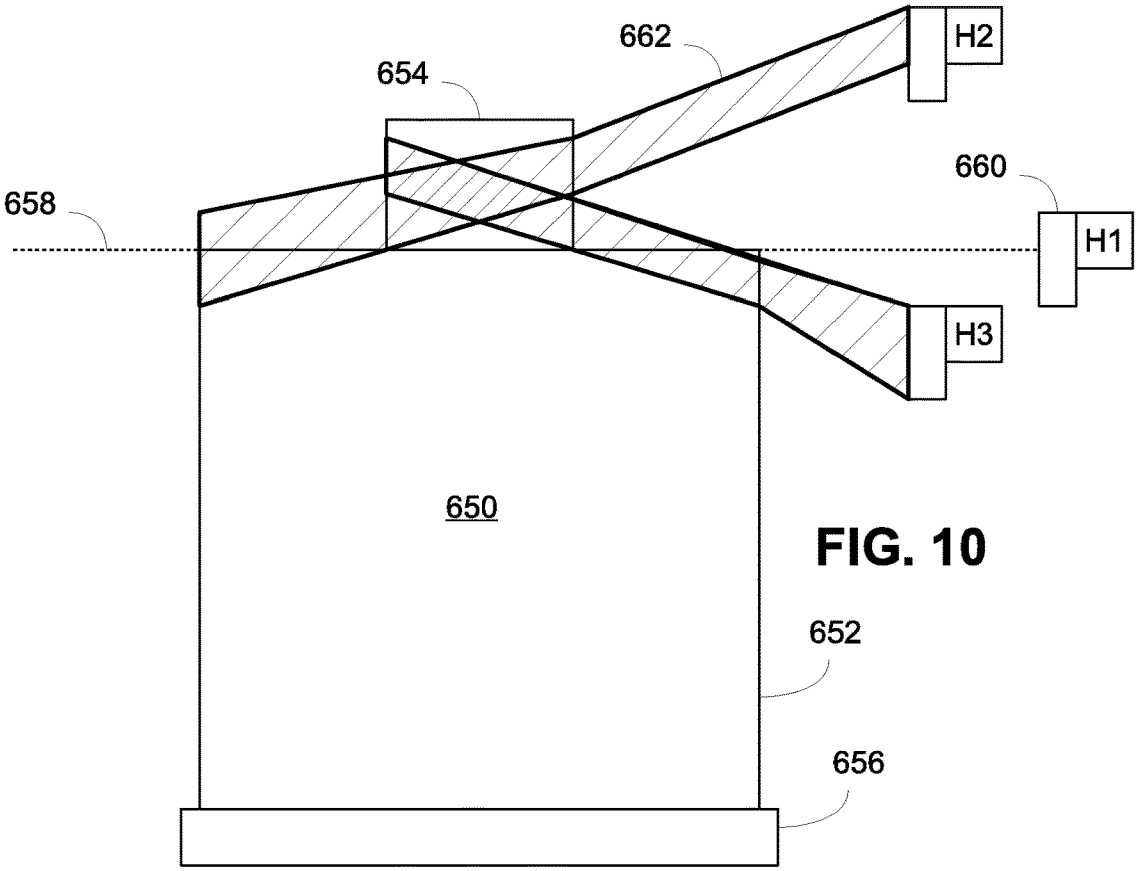
FIG. 10 is a functional side elevational view of an example load including an inboard portion consistent with the invention.

As shown in FIG. 10, a load 650 may include a main body 652 supporting an inboard portion 654 and supported on a pallet 656. Main body 652 includes a top surface defining a height illustrated at 658, relative to which multiple elevations (H1-H3) may be defined for a packaging material dispenser 660 that dispenses a web 662 of packaging material. In addition, as shown in FIG. 11, which is a top plan view of load 650 of FIG. 10, four rotational angles (A1-A4) and four load quadrants (Q1-Q4) may be defined relative to four corners (C1-C4) of load 650.

Figure 11:
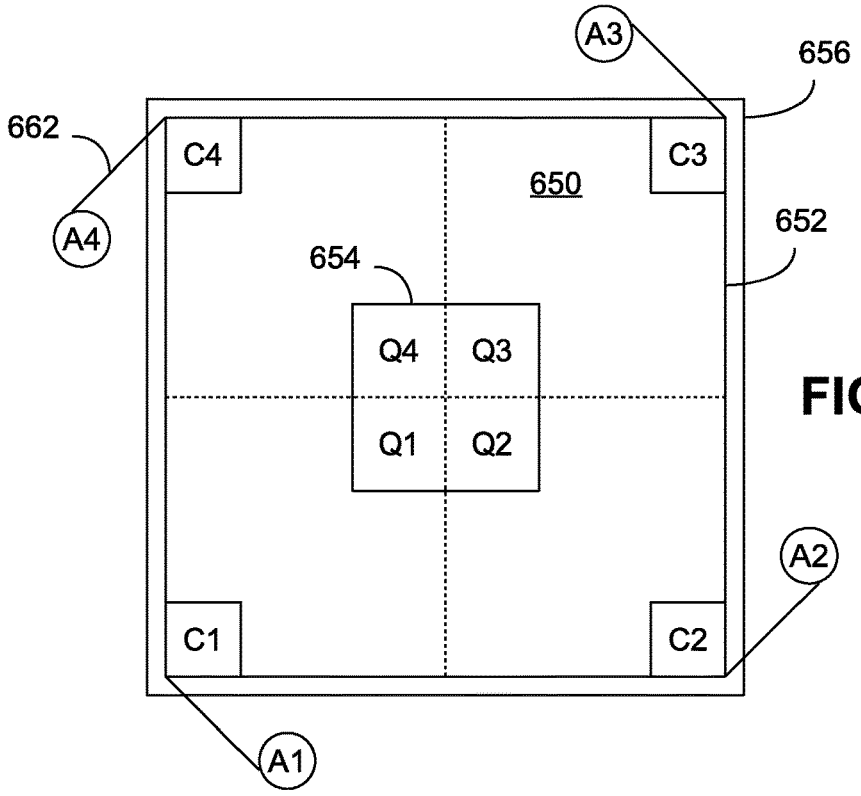
FIG. 11 is a functional top plan view of the example load of FIG. 10.
Figure 12:
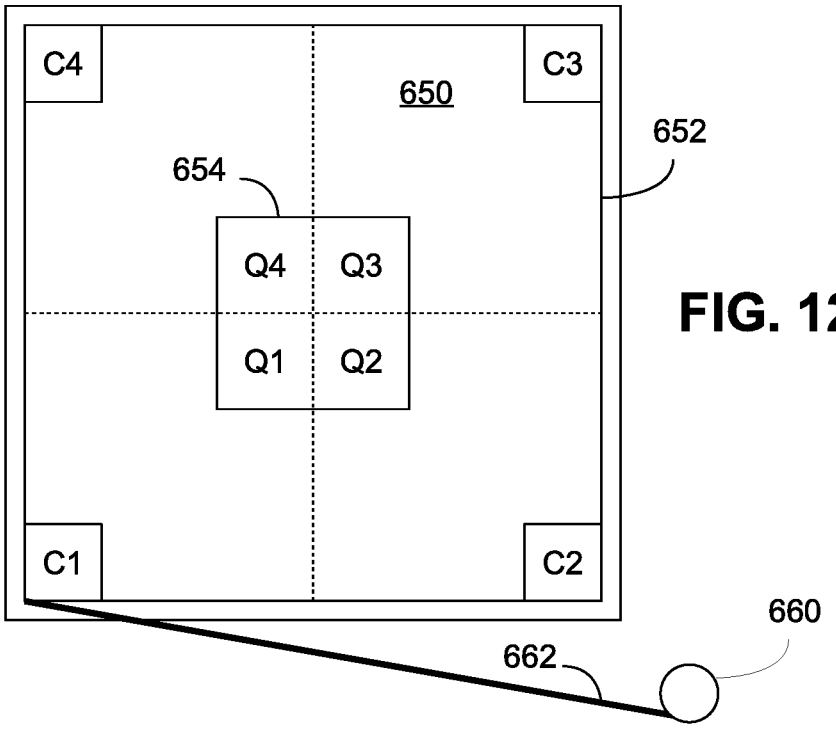
FIGS. 12-16 illustrate an example wrapping operation performed on the example load of FIGS. 10-11 in a manner consistent with the invention.
Figure 13:
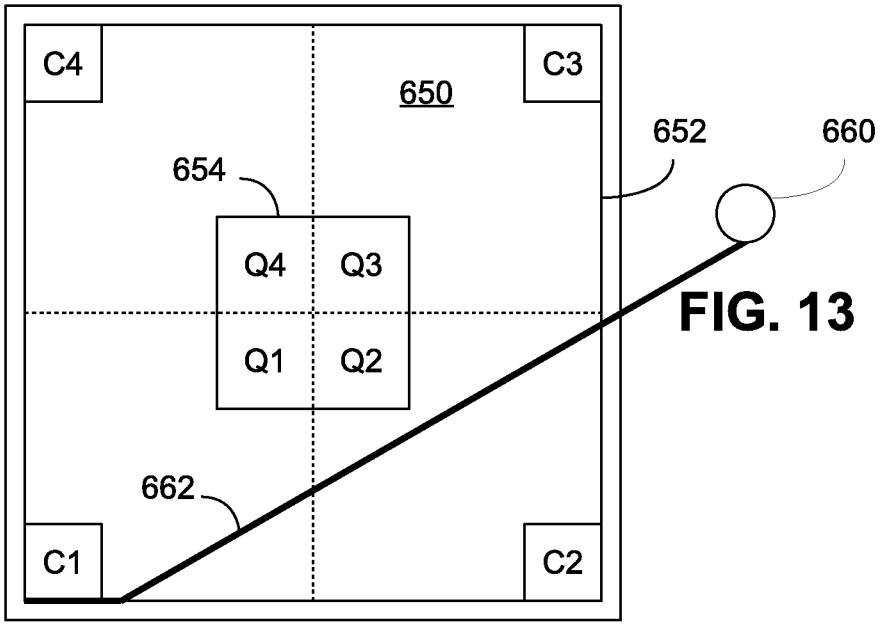

Turning to FIG. 12, and with continued reference to FIGS. 10 and 11, one control sequence consistent with the invention, which may also be referred to as a "U wrap" control sequence, may include, first, during a normal wrap cycle, traveling to the H1 position, which may be a position where approximately 50% of the width of web 662 overlaps the top of the main body 652 of load 650. This elevation may be set relative to height 658 determined with sensor 628 (FIG. 5). Next, in some embodiments the rate of relative rotation may be reduced approximately 50% or more to facilitate achieving a timely raising of the elevation of packaging material dispenser 660 and web 662. In addition, in some embodiments the wrap force may be reduced significantly so that the web does not displace inboard portion 654 on the top of main body 652. In some embodiments, relative rotation may be paused, while in some embodiments, no reduction in rotation speed may be required.

At approximately a predetermined rotational angle A1 (FIG. 11), the roping mechanism may be engaged to substantially narrow the web (e.g., about 50%) from the bottom edge and the elevation of the packaging material dispenser 660 and web 662 may be raised at full speed to the H2 elevation (FIG. 10), which, in the case of a 20" width packaging material, may be approximately 20" above the H1 elevation in some embodiments. Angle A1 may be selected as a rotational angle after the rotational angle at which engagement of web 662 with corner C1 occurs, but before a rotational angle at which the packaging material could make contact with corner C2. As illustrated in FIG. 12, followed by FIG. 13, continued rotation of packaging material dispenser 660 relative to load 650 results in a bottom edge of web 662 being at an elevation above main body 652 of load 650 such that web 662, passes inwardly, misses or avoids corner C2 of main body 652, and instead engages inboard portion 654 in one or more quadrants other than that facing corner C1 (i.e., quadrants Q2, Q3 and/or Q4 in FIG. 13).

Next, after a predetermined time or rotational angle change, packaging material dispenser 660 and web 662 may then be driven down to elevation H3 (FIG. 10), which in some embodiments using a 20" packaging material width may be approximately 15" below the H1 elevation, resulting in web 662 at least partially overlapping main body 652 to thereby engage with at least one of corners C3, C4 or C1. In addition, a roping mechanism may be disengaged to such that roping and narrowing of the web is discontinued to further lower the elevation of the web and thereby assist in engaging a corner of main body 652 of load 650.

Figure 14:
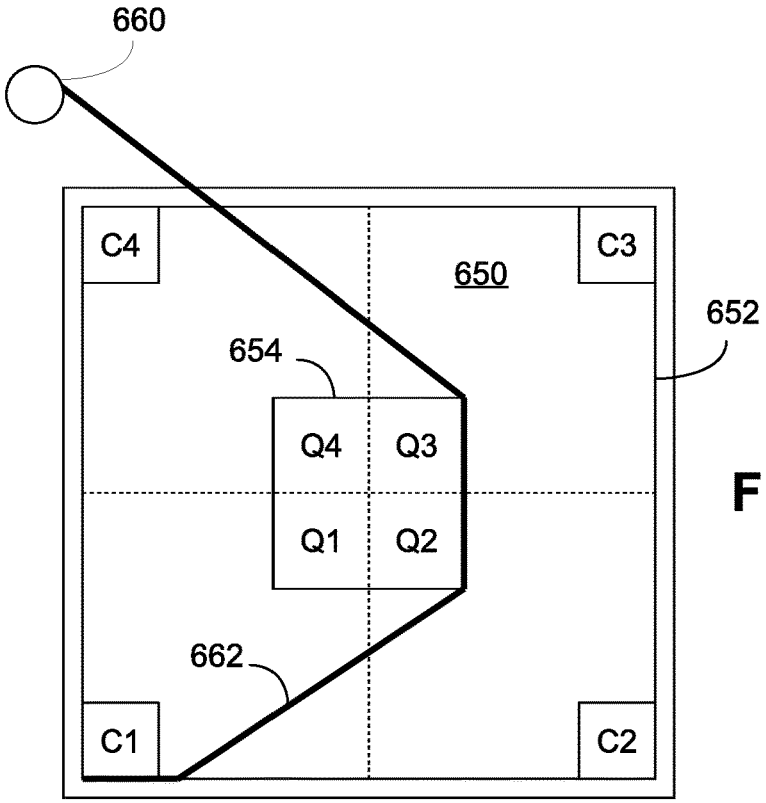
Figure 15:
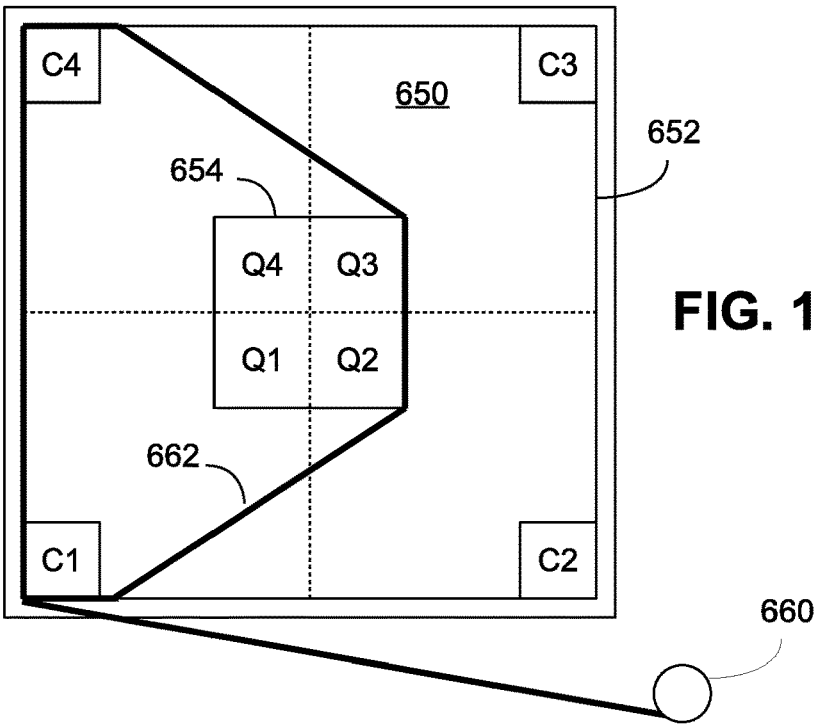

For example, FIG. 14 illustrates packaging material dispenser 660 after being driven down proximate rotational angle A3 (FIG. 11), but prior to contact with corner C4 of main body 652 of load 650. It will be appreciated that both corners C2 and C3 have been avoided, and web 662 instead engages quadrants Q2 and Q3 of inboard portion 654. Then, as illustrated in FIG. 15, continued rotation results in engagement between web 662 and corner C4, as well as completion of the revolution with web 662 additionally engaging and wrapping around corner C1.

Next, after a predetermined time or rotational angle packaging material dispenser 660 may be returned to elevation H1, and then proximate another predetermined rotational angle A2-A4, the aforementioned cycle may be repeated for one or more additional revolutions until a desired containment force is achieved and/or additional or all quadrants of the inboard portion are engaged by web 662.

Figure 16:
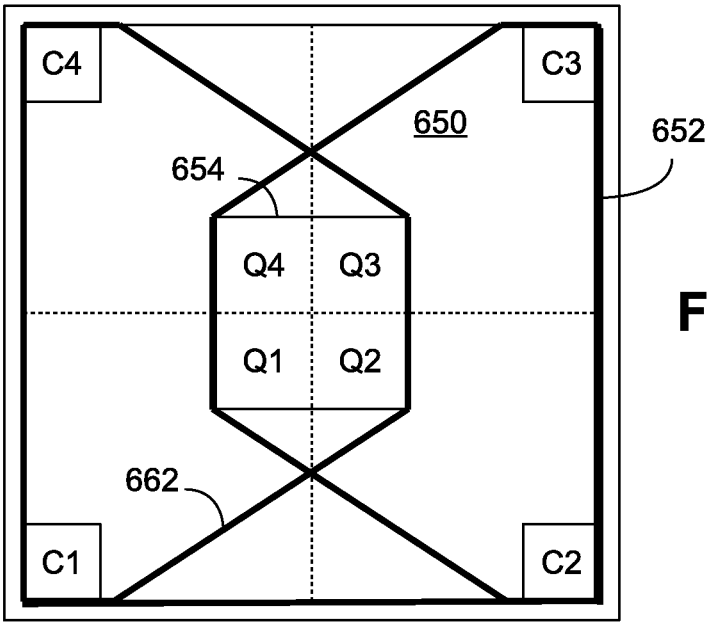

FIG. 16, for example, illustrates a wrapping pattern whereby the operations discussed above in connection with FIGS. 10-13, which produced a revolution that engaged corners C1 and C4 of main body 652 with quadrants Q2 and Q3 of inboard portion 654 are repeated starting proximate rotational angle A3 to produce a second revolution that engages corners C2 and C3 of main body 652 with quadrants Q1 and Q4 of inboard portion 654.

Figure 17:
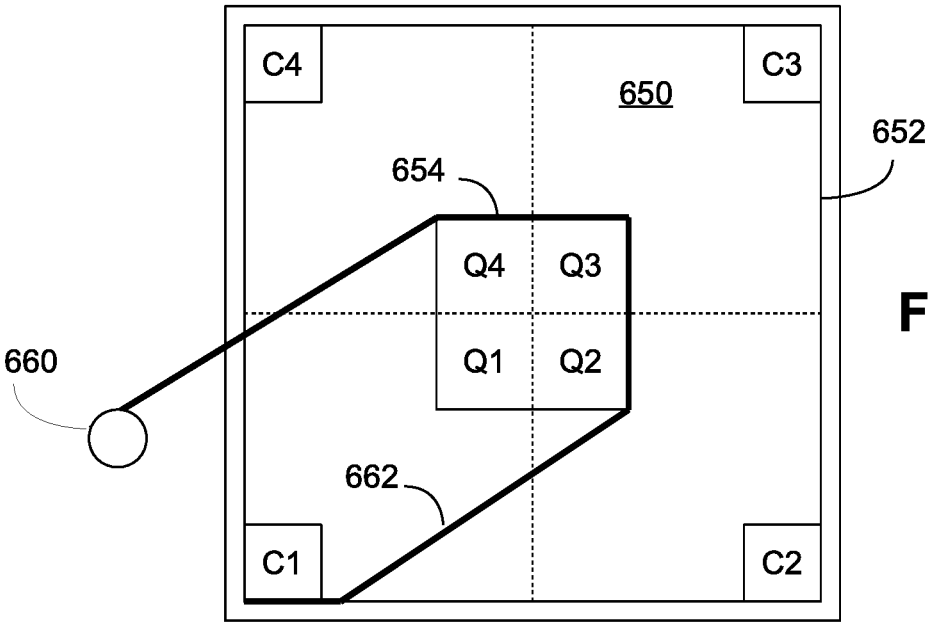
FIGS. 17-19 illustrate another example wrapping operation performed on the example load of FIGS. 10-11 in a manner consistent with the invention.
Figure 18:
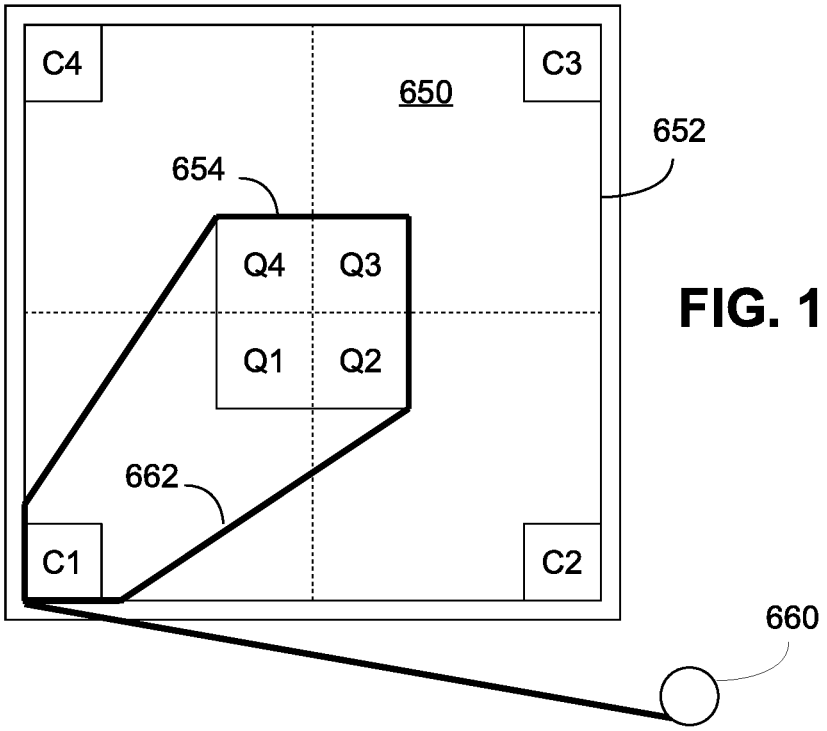
Figure 19:
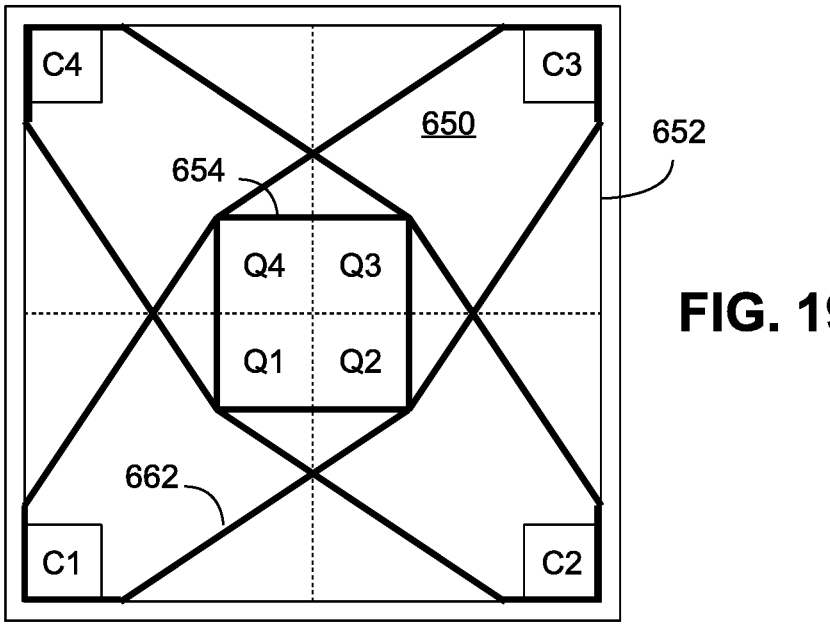

As another example, FIGS. 17 and 18 illustrate a revolution that engages a single corner (here corner C1) of main body 652 with three quadrants (Q2-Q4) of inboard portion 654, thereby passing inwardly of, skipping or avoiding corners C2-C4 of main body 652 with web 662. As shown in FIG. 19, the revolution illustrated in FIGS. 17 and 18 may be repeated for each corner C2-C4.

Figure 20:
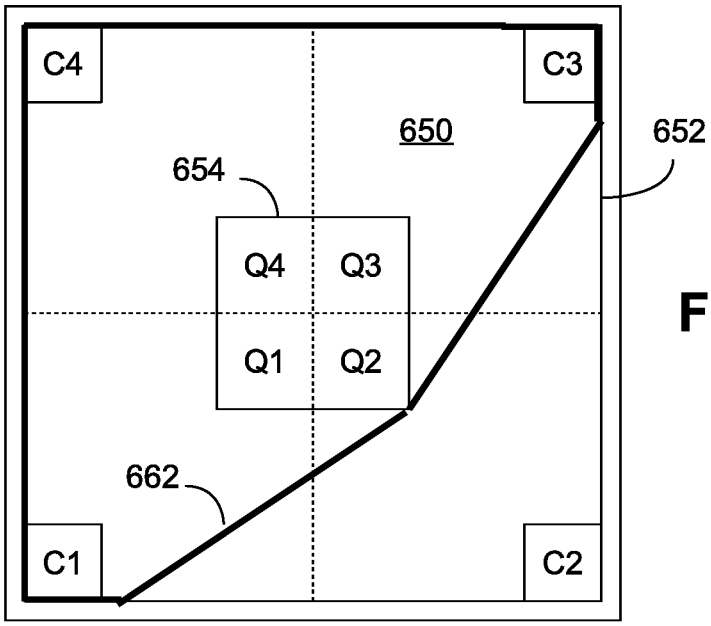
FIG. 20 illustrates yet another example wrapping operation performed on the example load of FIGS. 10-11 in a manner consistent with the invention.
Figure 21:
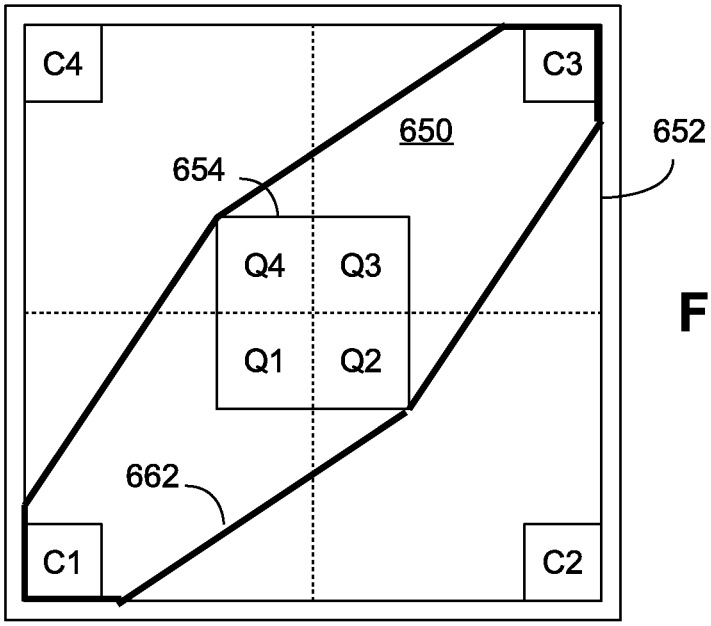
FIG. 21 illustrates another example wrapping operation performed on the example load of FIGS. 10-11 in a manner consistent with the invention.

As yet another example, FIG. 20 illustrates another revolution that passes inwardly of, skips or avoids a single corner C2, while engaging corners C1, C3 and C4 of main body 652 and quadrant Q2 of inboard portion 654. Likewise, FIG. 21 illustrates another revolution that engages corner C1, skips corner C2 and instead engages quadrant Q2, engages corner C3 and skips corner C4 and instead engages quadrant Q4, a control sequence also referred to herein as a "cross wrap" control sequence, similar to that illustrated in FIG. 9. Of note, this latter revolution completes a cycle of controlling the elevation of packaging material dispenser between elevations H1, H2 and H3 within approximately 180 degrees, or half of a revolution, with the same sequence repeated twice within a full revolution.

Any of the aforementioned revolutions may be repeated to increase overall containment force, and different types of revolutions may be combined in some embodiments. A revolution, in this regard, refers to a sequence of operations that begin and end proximate one corner of main body 652, and that pass inwardly of, skip or avoid at least one other corner of main body 652 while engaging one or more quadrants of inboard portion 654. Therefore, within a revolution in some embodiments, packaging material engages at least one corner of the supporting body at both a beginning and an end of the revolution, while also engaging the inboard portion in one or more quadrants and/or on a side of the load opposite the at least one corner of the supporting body.

A revolution therefore in some embodiments performs an inter-layer wrap that engages at least two layers—a first layer being disposed in the inboard portion of the load and a second layer being disposed in the main body of the load or the pallet. In addition, in some embodiments a revolution incorporates bidirectional changes in elevation of a web—raising in one direction when transitioning between engagement with a corner of the supporting body and engagement with the inboard portion of the load, and lowering in an opposite direction when transitioning between engagement with the inboard portion of the load and a corner of the supporting body.

Figure 22:
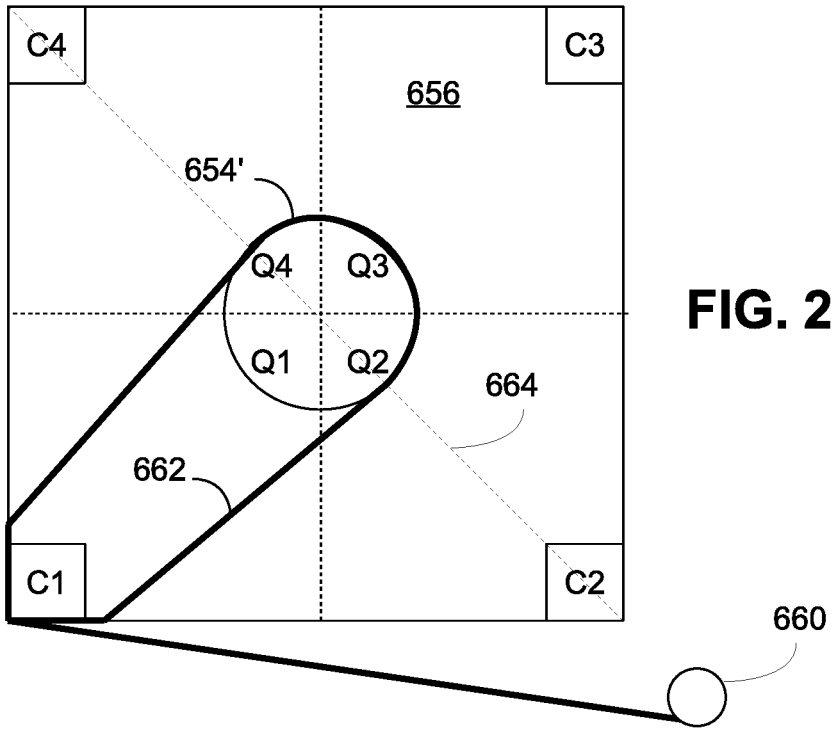
FIG. 22 illustrates another example wrapping operation performed on another example load consistent with the invention.

It will also be appreciated that the one or more quadrants of the inboard portion 654 are at least partially oriented on a side of the load that is opposite from the corner at which a revolution is initiated. As an example, FIG. 22 illustrates an inboard portion 654' of a load that is engaged on an opposite side of the load from corner C1, e.g., as defined by line 664 extending between corners C2 and C4. FIG. 22 also illustrates a number of other features, including that inboard portion 654' is not rectangular in cross section, and that inboard portion 654' is supported by pallet 656 rather than a main body of a load. It will be appreciated that in this example, quadrant Q3, and at least portions of quadrants Q2 and Q4, of inboard portion 654' are disposed on an opposite side of the load from corner C1.

It will also be appreciated that sequential revolutions may be separated by portions of the web that are wrapped around one or more corners of main body 652, as it may be necessary in some embodiments to rotate around one or more corners in order to reach a desired corner at which a particular revolution will be begun. For example, as illustrated in FIGS. 15 and 16, after completion of the first revolution proximate corner C1, the second revolution may not be initiated until after packaging material has been wrapped around corner C2 and has subsequently engaged corner C3.

Therefore, in some embodiments, multiple revolutions may be applied to a load starting at different corners, and moreover, revolutions may be repeated at the same corners in some embodiments to increase overall containment force. Particularly where an inboard portion of a load is light and/or little friction exists between the inboard portion of the load and the supporting body, it may be desirable to apply at least one revolution at a lowered wrap force to minimize displacement or slippage of the inboard portion of the load, and then apply additional revolutions at higher wrap forces to provide a desired overall containment force.

Determination of rotational angles and web elevations to use within a revolution may be made in a number of manners, as will be appreciated by those of ordinary skill in the art having the benefit of the instant disclosure. For example, rotational angles may be measured via a rotary encoder or other angle sensor in some embodiments, while in other embodiments, rotational angles may be estimated based upon the known rotational speed and location of a home position. In the latter instance, for example, if it is known that the rotational speed is 10 RPM, a full rotation at that speed is completed in approximately 6 seconds, and it may therefore be determined that each corner of the main body of a load is engaged approximately 1.5 seconds after a last corner is engaged (with the location of a first corner relative to a home position being readily determinable based upon the location of the packaging material dispenser relative to the home position). Thus, in some embodiments, no actual sensing of the rotational angle of a packaging material dispenser relative to a load is required. Other techniques to determine rotational angles, e.g., as disclosed in U.S. Pub. No. 2014/0116008 to Lancaster et al., which is incorporated by reference herein, may also be used.

Likewise, elevations may be determined relative to a height of a supporting body and a width of the web of packaging material (either on the roll, or when extended between the load and the packaging material dispenser). The height of the supporting body may be input to the controller or may be sensed, e.g., with a photoelectric detector such as illustrated in FIG. 5.

In one example embodiment, the home position may conform to a rotational angle of one of the corners and thus, based on the rotational speed between the packaging material and the load, a time duration ($T_C$) may be determined for each subsequent corner by dividing the duration of one complete rotation by four. The time duration for each corner may then be used to set timers for moving the packaging material dispenser to different predetermined elevations and/or engaging or disengaging a roping mechanism to apply one or more desired revolutions to the load.

As one example, if it is desired to apply the revolution illustrated in FIG. 15 to a load, and assuming that the home position corresponds to corner C1, a control sequence may be triggered when the top of the main body of the load is detected to first drive the packaging material dispenser to the H1 elevation and then, upon detection of the home position, initiate a movement of the packaging material dispenser to the H2 position and engage the roping mechanism. A timer may also be set with a duration equivalent to one corner ($T_C$) such that at the expiration of the timer, the web of packaging material has moved to an elevation that avoids corner C2 and engages the inboard portion of the load in quadrant Q2.

Next, a second timer may be set with a duration equivalent to one corner ($T_C$), with the packaging material dispenser maintained at the same elevation, such that the web of packaging material also avoids corner C3 and engages the inboard portion of the load in quadrant Q3.

Upon expiration of the second timer, movement of the packaging material dispenser to the H3 position, and disengagement of the roping mechanism, may then be initiated, and a third timer equivalent to one corner ($T_C$) may be set, such that after expiration of that timer, the elevation of the packaging material dispenser has been decreased to a point in which the packaging material engages corner C4. A fourth timer equivalent to one corner ($T_C$) may also be set such that at the expiration of that timer, the revolution is complete.

Should multiple revolutions be applied starting at different corners, the fourth timer may be set to the duration of multiple corners to start the next revolution at the appropriate corner. For example, to apply the second revolution illustrated in FIG. 16, the fourth timer may be set to the duration of three corners ($3\times T_C$), and the elevation of the packaging material dispenser may be set to the H1 elevation, such that the web of packaging material, after engaging corner C4, is wrapped around corners C1 and C2, and upon expiration of the timer, has engaged corner C3 at the H1 elevation, and ready to repeat the aforementioned control sequence for the second revolution starting at corner C3.

Various modifications may be made to aforementioned techniques without departing from the spirit and scope of the invention. For example, the aforementioned techniques may be used to secure an inboard portion to a pallet rather than a main body of a load. In addition, as noted above, a roping mechanism may or may not be used, and in some embodiments, the roping mechanism may be controlled when wrapping around quadrants of an inboard portion to selectively narrow the web and provide a rope along the bottom edge of the web. In some embodiments, an initial revolution may be performed at a reduced wrap force to minimize shifting of a light or unstable inboard portion, and in some embodiments, the initial revolution may be repeated at a higher wrap force. It still other embodiments, the wrap force may be dynamically adjusted to compensate for elevation changes in the web. In some embodiments, relative rotation may be selectively slowed or stopped within a revolution to assist a web in passing inwardly of or avoiding a corner of a supporting body, while in other embodiments, relative rotation may occur at full speed.

In addition, in some embodiments the H1 elevation may engage the supporting body over lesser or greater portions of the width of a web. Moreover, the H2 and/or H3 elevations may be selected to "overshoot" in some embodiments to assist in avoiding or capturing a corner of a supporting body. Further, in some embodiments the elevation of the web may be reversed after such an overshoot to control an elevation at which the web engages the inboard portion of the load and/or supporting body. In some embodiments, furthermore, the H2 elevation may be above that of the inboard portion of the load. In addition, in some embodiments, the H2 elevation may be a variable offset based upon the dimensional height of the inboard portion, e.g., based upon a linear or non-linear relationship to the dimensional height of the inboard portion.

Determination of the H1 position may also vary in different embodiments. For example, in some embodiments, the H1 position may be determined relative to the sensed height of the main body of a load or of a pallet, similar to that discussed above in connection with FIG. 10. In other embodiments, however, the H1 position may be relative to the sensed height of the inboard portion of a load. In the former instance, for example, a photoelectric sensor, shape sensing camera, or other sensor may be used to directly determine a height of the surface upon which the inboard portion is supported, and the H1 position may be determined, e.g., based upon a fixed offset from the determined height.

In the latter instance, any of such sensors may be used to directly determine a height of the inboard portion of the load, and then this height may be used to derive the H1 position. In some embodiments, for example, the dimensional height of the inboard portion of the load may be known or fixed, or may be otherwise input to the controller, and the H1 position may be determined using a fixed offset, with or without first determining the height of a supporting body from the sensed height.

In some instances, the sensor used to directly determine the height of the inboard portion of the load may be the same sensor used to determine the height of a load not having an inboard portion. In other instances, however, it may be desirable to use a different sensor to sense the height of an inboard portion. In either instance, the sensor used to sense the top of the inboard portion of the load may be mounted at a fixed position above a packaging material dispenser and at an elevation that allows the sensor to sense the top of the inboard portion before the web of packaging material collapses into space or breaks on the top corners of the supporting body (e.g., at a fixed position similar to that illustrated for position-adjustable sensor 674 of FIG. 23, discussed below). The packaging material dispenser may then be positioned to a predetermined elevation with a predetermined offset from the sensed top of the inboard portion of the load, e.g., based upon an input of the dimensional height of the inboard portion to the controller. In one embodiment, for example, the elevation offset for an elevated fixed position sensor may be selected such that less than about 75% of the web of packaging material is above the top of a supporting body when the top of the inboard portion of the load is sensed.

In other embodiments, a wrapping apparatus may be configurable by an operator for a particular load by adjusting the position of a sensor to compensate for the dimensional height of an inboard portion of a load. In this regard, the dimensional height of the inboard portion of the load refers to a dimension of the inboard portion itself taken along the height direction, and thus, the dimensional height of the inboard portion does not change based upon the height of the supporting body upon which the inboard portion is supported.

Figure 23:
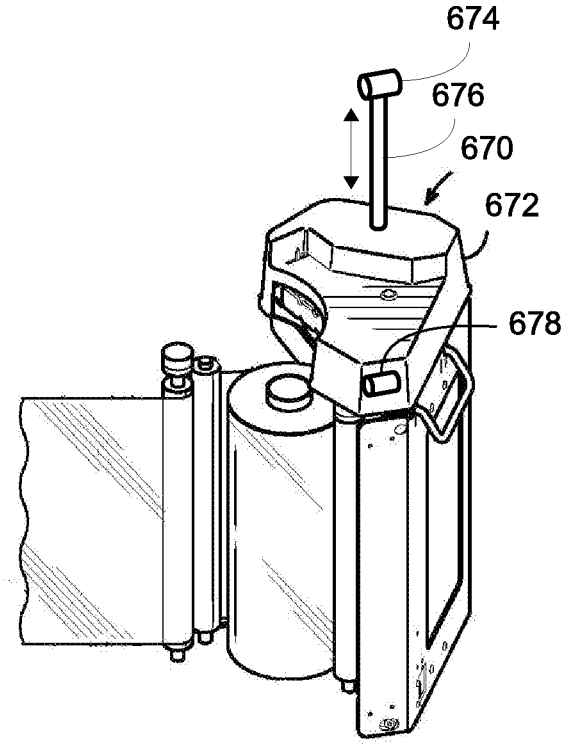
FIG. 23 is a perspective view of a packaging material dispenser with an adjustable height sensor consistent with the invention.

FIG. 23, for example, illustrates a packaging material dispenser 670 mounted to a roll carriage or elevator 672, and similar to packaging material dispenser 610 of FIG. 5. However, packaging material dispenser 670 includes a position-adjustable sensor 674, e.g., a photoelectric sensor, that is mounted to a mast 676 that may be raised or lowered by an operator to compensate for the dimensional height of the inboard portion of the load. In this regard, the position-adjustable sensor is adjustable among a plurality of positions or heights relative to the packaging material dispenser to compensate for the dimensional height of the inboard portion of the load.

In some embodiments, sensor 674 may be adjustably-positioned along the length of mast 676, while in other embodiments, sensor 674 may be fixed on mast 676, with mast 676 being adjustable relative to a mount that secures mast 676 to packaging material dispenser 670. In some embodiments, mast 676 may include dimensional indicators along its length such that an operator may move sensor 674 to a position corresponding to the dimensional height of the inboard portion of the load, such that, for example, if an operator desired to wrap a load with an inboard portion that is 8" high, the operator could move sensor 674 to the position corresponding to the 8" dimensional indicator. Particularly in applications where a single case size is used to ship multiple loads of products, sensor 674 may be positioned once based upon the dimensional height of the case, and thereafter the multiple loads may be wrapped without the need to readjust the position of the sensor for each load. In some embodiments, the dimensional indicators may be based upon a scale or table, and as such, movement of sensor 674 may not correspond 1:1 with changes in the dimensional height of the inboard portion of the load. Further, in some embodiments, a non-linear relationship may exist between the optimum position of the sensor based upon the dimensional height of the inboard portion of the load.

Sensor 674 may be used in lieu of a fixed sensor in some embodiments. In other embodiments, however, multiple sensors may be used, e.g., such that sensor 674 is used along with a fixed position sensor 678.

In still other embodiments, an off-axis sensor may be used to detect the height of a supporting body. The term "off-axis", in this regard, refers to a sensing direction of a sensor that does not intersect the axis of rotation between a load and a packaging material dispenser.

Figure 24:
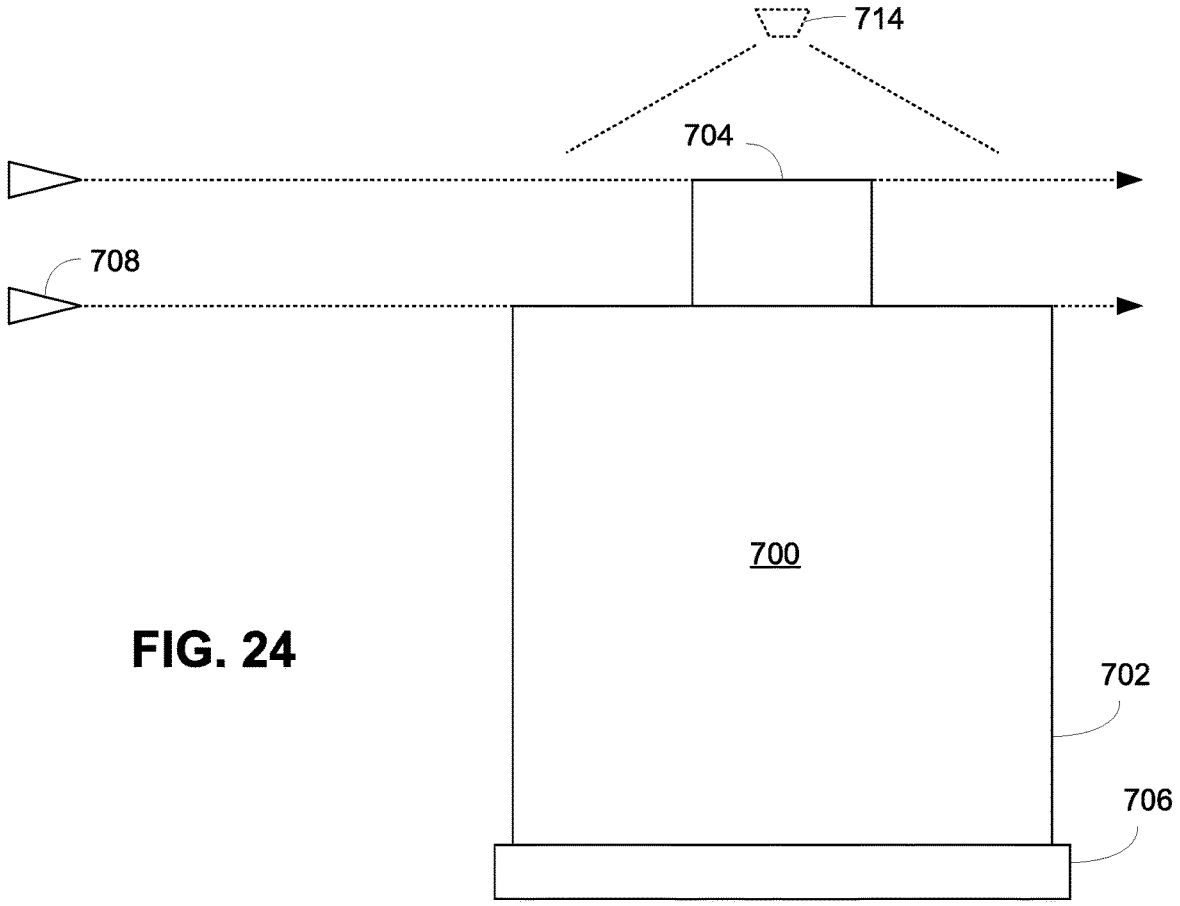
FIG. 24 is a functional side elevational view of another example load including an inboard portion consistent with the invention, and further illustrating the use of multiple height sensors consistent with the invention.
Figure 25:
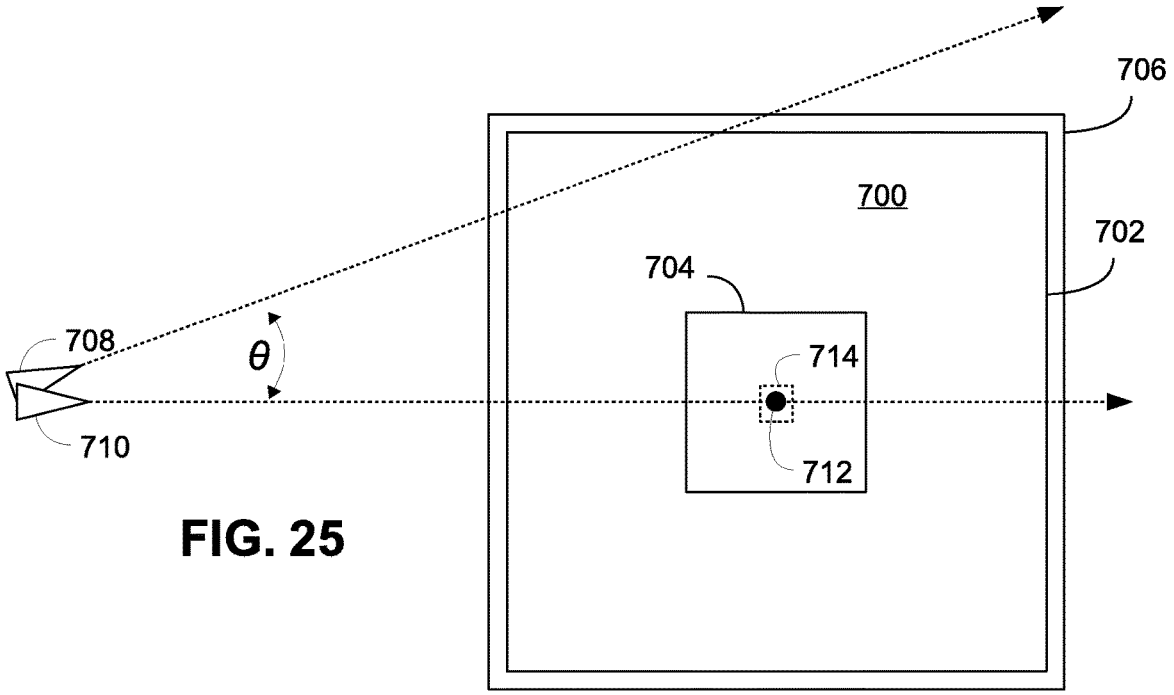
FIG. 25 is a functional top plan view of the example load of FIG. 24.

With reference to FIGS. 24-25, for example, a load 700 may include a main body 702 supporting an inboard portion 704 and supported on a pallet 706. As shown in FIG. 24, a first, off-axis sensor 708 may be disposed at a first elevation relative to a roll carriage or elevator and a second, on-axis sensor 710 is disposed at a second, higher elevation relative to the roll carriage or elevator, and offset a predetermined distance from the first sensor 708. As shown in FIG. 25, off-axis sensor 708 is directed at an angle θ offset from an axis of rotation 712 of load 700, while on-axis sensor 710 is directed toward axis of rotation 712.

By directing off-axis sensor 708 offset from axis of rotation 712, off-axis sensor 708 may detect the presence of main body 702 without detecting inboard portion 704. In some embodiments, for example, off-axis sensor 708 may be oriented to detect main body 702 of load 700 about 10" inside of a corner of main body 702 when main body 702 is oriented in the position illustrated in FIG. 25, although other orientations relative to load 700 and/or axis of rotation 712 may be used in other embodiments. In some embodiments, each sensor 708, 710 may be implemented using a laser or photoelectric proximity sensor based upon time-of-flight sensing, e.g., the FT55-RLHP2 sensor available from Sensopart Industriesensorik GmbH.

In addition, in some embodiments, it may be desirable to sense the heights of the supporting body and/or inboard portion of the load while the load is stationary (i.e., when there is no relative rotation between the load and a packaging material dispenser). In one embodiment, for example, a wrap cycle may begin with a roll carriage or elevator rising from a bottom position while no relative rotation is performed between the load and the packaging material dispenser. During this process, off-axis sensor 708 scans for the top of main body 702 while on-axis sensor 710 scans for the top of inboard portion 704. The H1 position is determined based upon the height of main body 702 sensed by off-axis sensor 708, while the H2 position is determined based upon the height of inboard portion 704 sensed by on-axis sensor 710, generally with offsets applied to each sensed height. The H3 position may also be determined based upon an offset relative to either the height sensed by off-axis sensor 708 or based upon an offset relative to the determined H1 position.

Once the H1-H3 positions are determined, the roll carriage or elevator may be moved to the H1 position and wrapping via relative rotation may commence. In addition, in some embodiments, if the roll carriage or elevator passes the determined H1 position plus a predetermined offset before the top of the inboard portion is detected by on-axis sensor 710, the roll carriage or elevator may reverse back to the H1 position prior to initiating the relative rotation. Of note, in this embodiment, wrapping begins proximate the top of a load, rather than proximate the bottom. Furthermore, in some embodiments, the inboard portion is secured to the main body prior to wrapping the main body, and as a result, the wrapping of packaging material around the main body may serve to further secure the inboard portion as packaging material is wrapped around the top of the main body as well as around the packaging material from the inter-layer wraps that secure the inboard portion to the main body of the load.

It will be appreciated that on-axis sensor 710 in some embodiments need not be directed precisely at the axis of rotation, and may be directed off-axis to some extent, generally to a lesser extent than off-axis sensor 708 such that on-axis sensor 710 is capable of sensing the height of the inboard portion of the load. In general, each of sensors 708, 710 may be directed at various angles and/or directions relative to the axis of rotation based upon the particular load and/or configuration of a wrapping apparatus.

In still other embodiments, determination of the presence and/or dimensions of an inboard portion of a load may be made using one or more sensors capable of automatically determining a three-dimensional profile of at least the top of a load. Various types of cameras, range imaging sensors, three-dimensional scanning sensors, etc. may be used, for example, to determine a complete profile of the top of a load, including the topography of the top of the load as well as the overall length and width of a main body of the load. In some embodiments, other types of information related to a three-dimensional profile may also be sensed and/or derived from a three-dimensional profile, e.g., the presence/absence of an inboard portion, the height of the inboard portion and/or a supporting body of the load, the dimensions, orientation and/or position of an inboard portion and/or any individual cartons or products making up an inboard portion, etc.

In some embodiments, one or more sensors (e.g., sensor 714 illustrated as an alternative to sensors 708, 710 in FIGS. 24-25) may be oriented to project downwardly and capture one or more images from above a load to determine a three-dimensional profile or information related thereto, while in some embodiments one or more sensors may be oriented to capture one or more images from the side of a load. Other variations for capturing the profile of the top of a load will be appreciated by those of ordinary skill in the art having the benefit of the instant disclosure.

Figure 26:
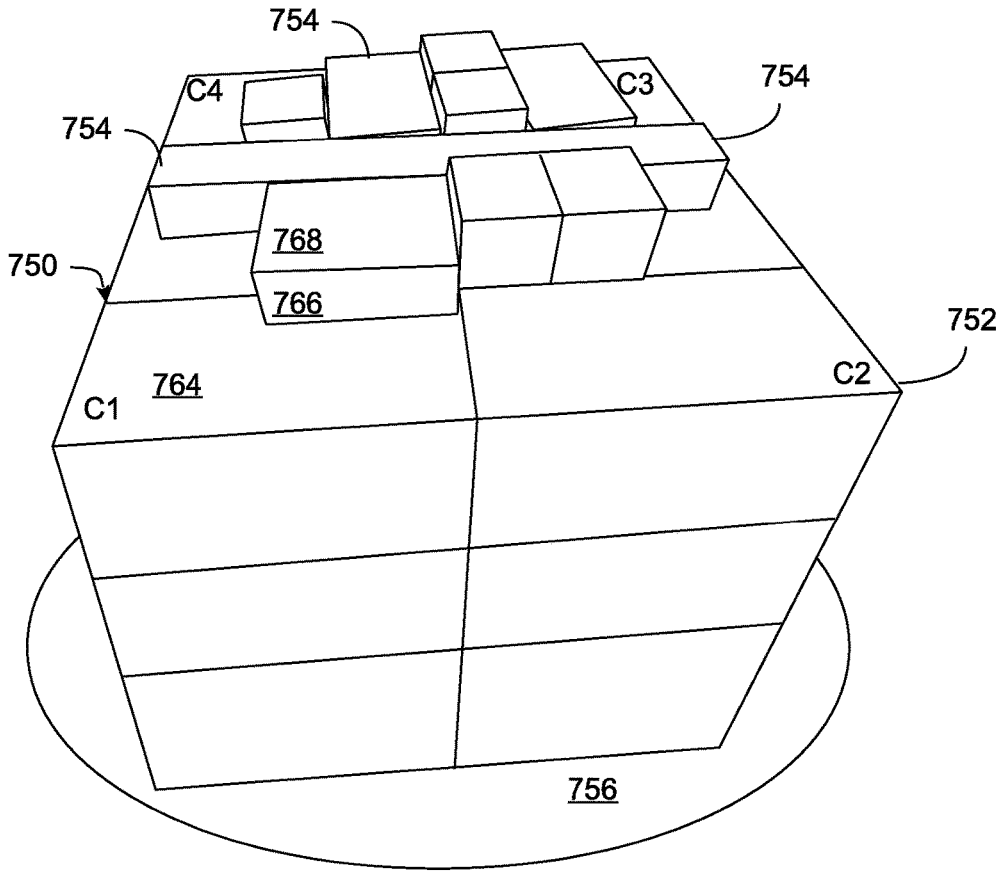
FIG. 26 is a perspective view of an example load including a ragged topography.
Figure 27:
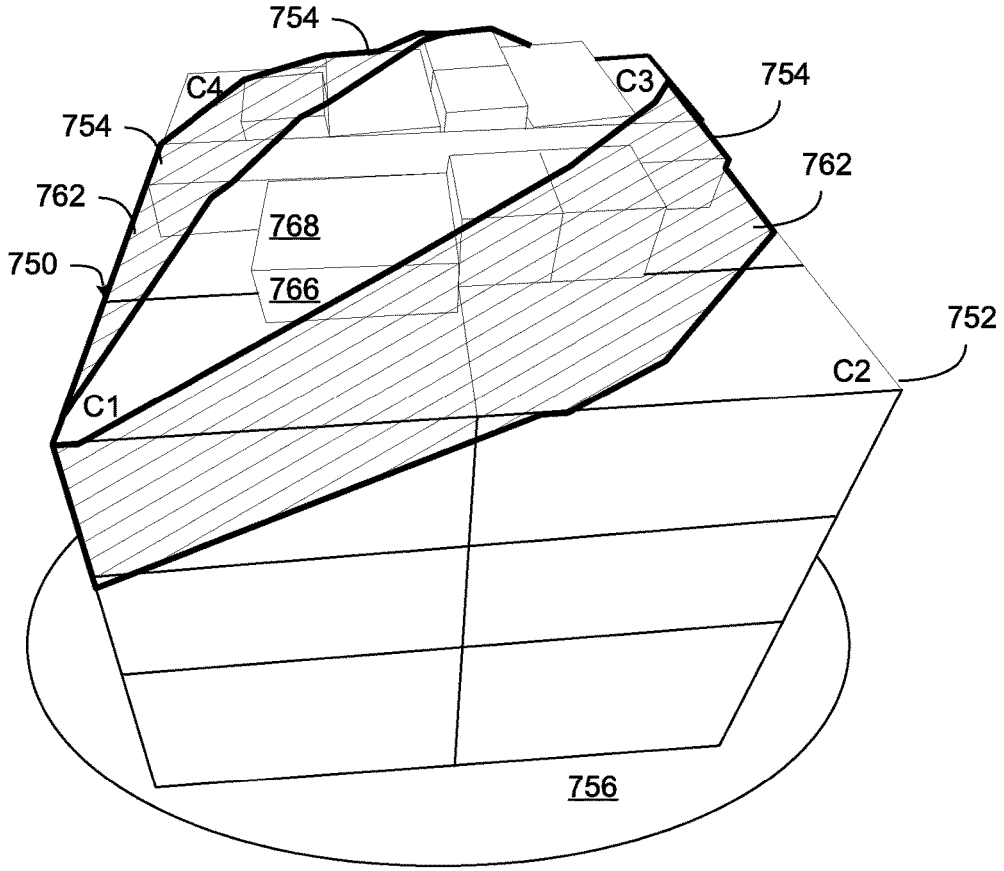
FIGS. 27-28 illustrate an example wrapping operation performed on the example load of FIG. 26 in a manner consistent with the invention.
Figure 28:
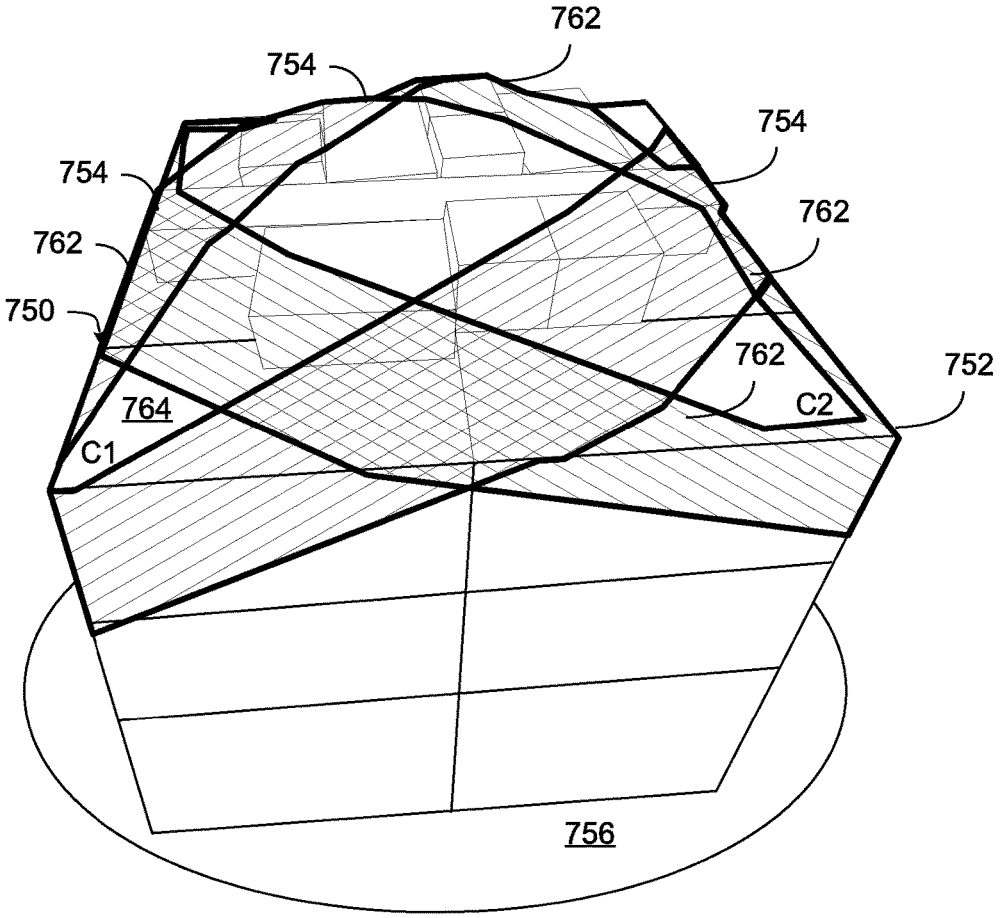

Now turning to FIGS. 26-28, another example load 750 is illustrated, including a main body 752, a plurality of cartons 754, and a pallet 756. Four corners C1-C4 are defined on the load, with corners C1 and C3 forming one pair of opposing corners and corners C2 and C4 forming another pair of opposing corners. Cartons 754, being placed inboard of main body 752, may be considered to represent an inboard portion. In addition, it should be noted that cartons 754 are of differing dimensions (lengths, widths and/or heights), and as such, may also be considered (in combination with main body 752) to present a load with a ragged topography due to the differing elevations of the load at different points along the top surface(s) of the load. It will also be appreciated that while load 750 is illustrated with a regular, cuboid-shaped main body 752, in other embodiments, a load lacking a cuboid-shaped main body may also be considered to have a ragged topography, e.g., where a load consists of a plurality of stacked and differently dimensioned cartons or products that are not stacked into defined layers.

In this embodiment, a top layer containment operation implementing a "cross wrap" sequence similar to that described above in connection with FIGS. 20 and 21 may be used to address the ragged topography, whereby within a revolution a web of packaging material may engage each of a first pair of opposing corners and may pass inwardly of each of a second pair of opposing corners to contain cartons 754 on main body 752. Specifically, in some embodiments the elevation of a web may be controlled at least in part by raising the elevation of a web after engaging a corner of the first pair of opposing corners and before passing inwardly of an immediately subsequent corner of the second pair of opposing corners, and lowering the elevation of the web after passing inwardly of the immediately subsequent corner of the second pair of opposing corners and engaging an immediately subsequent corner of the first pair of opposing corners. When passing inwardly of each corner in the second pair of opposing corners, the web may engage a top surface of the main body, the sides of one or more cartons 754 and/or the top surfaces of one or more cartons 754, based at least in part upon the placement and dimensions of the cartons.

FIG. 27 illustrates a first revolution of a cross wrap sequence in which a web 762 of packaging material engages corner C1, passes inwardly of corner C2, engages corner C3, passes inwardly of corner C4, and again engages corner C1, with portions of the web 762 overlapping or engaging a top surface 764 of main body 752, side surfaces 766 of one or more cartons 754 and/or top surfaces 768 of one or more cartons 754. It will be appreciated that a similar wrap pattern may also be applied if the revolution is begin at corner C3.

Next, as shown in FIG. 28, in a second revolution, which may begin 90 degrees, 270 degrees, 450 degrees, etc. after the completion of the first revolution, another cross wrap sequence is performed, but starting at a corner from the other pair of opposing corners (i.e., corner C2 or C4). Assuming, for example, that the second revolution begins 90 degrees (about a quarter of a revolution) after the first revolution, during the 90 degrees of rotation, the elevation of the web may be held at substantially the same elevation to enable the web to wrap around the side of the load and engage corner C2. Thereafter, the web passes inwardly of corner C3, engages corner C4, passes inwardly of corner C1, and again engages corner C2, with portions of the web 762 again overlapping or engaging a top surface 764 of main body 752, side surfaces 766 of one or more cartons 754 and/or top surfaces 768 of one or more cartons 754. FIG. 28 also illustrates how in some embodiments, a corner (e.g., corner C2) may be considered to be engaged by web 762 even when a portion of the width of the web extends above the corner (in contrast with corner C1, where the full width of the web engages and extends around the corner).

In addition, in this embodiment, no roping mechanism is used, and the full width of the web is maintained throughout the operation, i.e., an open web is used. In other embodiments, a roping mechanism may be used to selectively narrow the web. In still other embodiments, a roping mechanism may be used to form a complete rope from the web, and remain engaged throughout the operation or different specific portions of the operation such that a rope of packaging material is wrapped in the aforementioned cross wrap sequence.

Securing Top/Slip Sheets

Another type of top layer containment operation that may be performed in some embodiments of the invention is an operation to secure a top sheet or slip sheet to the top of a standard cuboid-shaped load. A top sheet may be formed of packaging material and may be used to protect a load from dust or moisture. A slip sheet may be formed of plastic, cardboard, fiberboard or another material and may be used to protect a load from damage or deformation when other loads are stacked on top the load.

For such applications, a top layer containment operation implementing a "cross wrap" sequence similar to that described above in connection with FIGS. 20 and 21 may be used, whereby within a revolution a web of packaging material may engage each of a first pair of opposing corners and may pass inwardly of each of a second pair of opposing corners. Specifically, in some embodiments the elevation of a web may be controlled at least in part by raising the elevation of a web after engaging a corner of the first pair of opposing corners and before passing inwardly of an immediately subsequent corner of the second pair of opposing corners, and lowering the elevation of the web after passing inwardly of the immediately subsequent corner of the second pair of opposing corners and engaging an immediately subsequent corner of the first pair of opposing corners.

Figure 29:
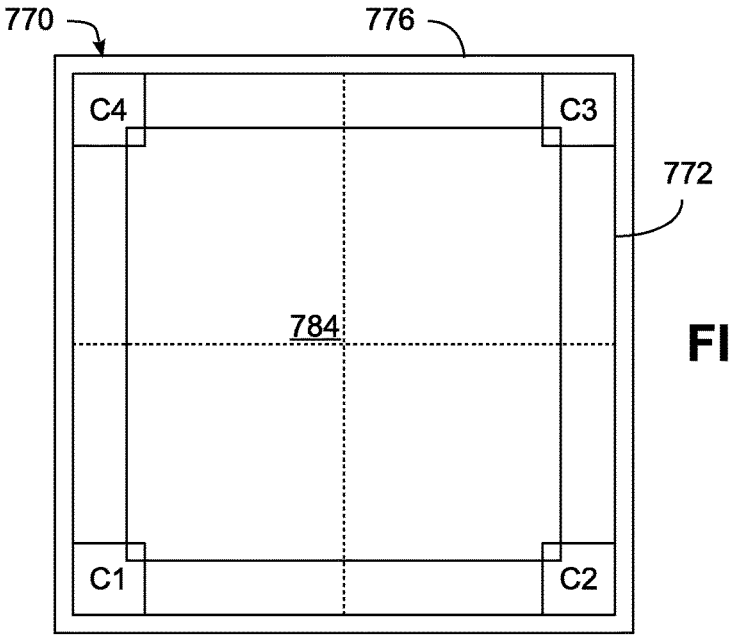
FIG. 29 is a functional top plan view of an example load including a slip sheet.
Figure 30:
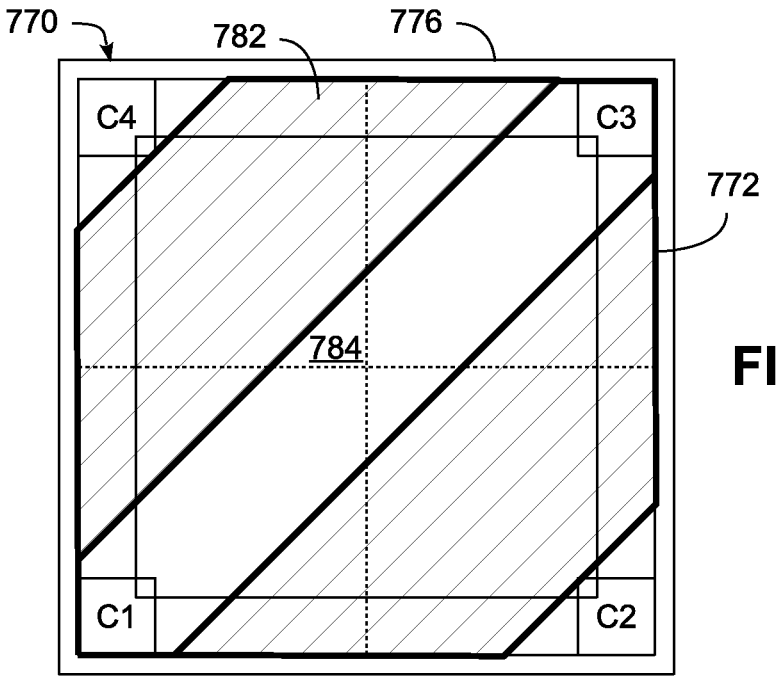
FIGS. 30-31 illustrate an example wrapping operation performed on the example load of FIG. 29 in a manner consistent with the invention.

FIG. 29, for example, illustrates an example load 770 including a substantially cuboid-shaped main body 772 supported on a pallet 776, and upon which is placed a top or slip sheet 784. Four corners C1-C4 are defined on the load, with corners C1 and C3 forming one pair of opposing corners and corners C2 and C4 forming another pair of opposing corners. FIG. 30 next illustrates a first revolution of a cross wrap sequence in which a web 782 of packaging material engages corner C1, passes inwardly of corner C2, engages corner C3, passes inwardly of corner C4, and again engages corner C1, with the web 782 overlapping the top or slip sheet 784. It will be appreciated that a similar wrap pattern may also be applied if the revolution is begin at corner C3.

Figure 31:
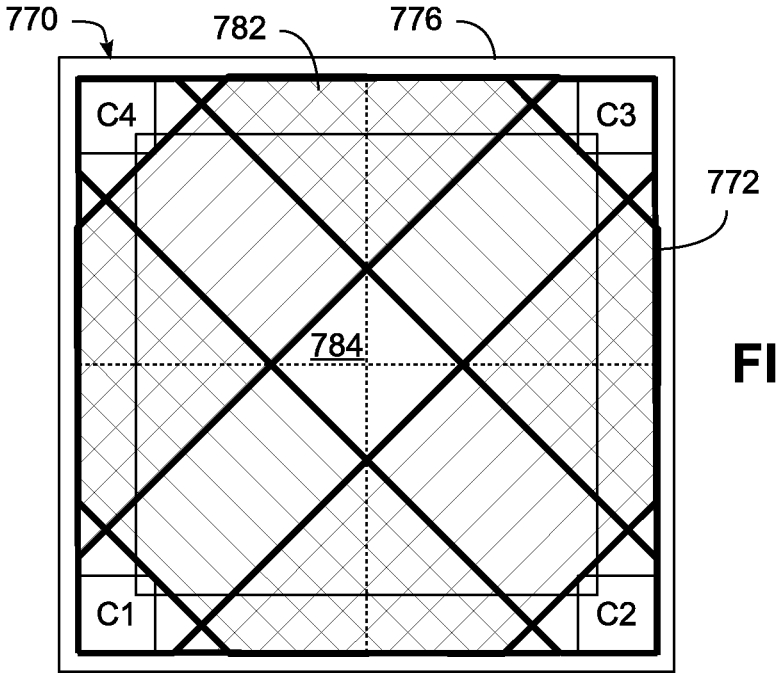

Next, as shown in FIG. 31, in a second revolution, which may begin 90 degrees, 270 degrees, 450 degrees, etc. after the completion of the first revolution, another cross wrap sequence is performed, but starting at a corner from the other pair of opposing corners (i.e., corner C2 or C4). Assuming, for example, that the second revolution begins 90 degrees (about a quarter of a revolution) after the first revolution, during the 90 degrees of rotation, the elevation of the web may be held at substantially the same elevation to enable the web to wrap around the side of the load and engage corner C2. Thereafter, the web passes inwardly of corner C3, engages corner C4, passes inwardly of corner C1, and again engages corner C2, with the web 782 again overlapping the top or slip sheet 784.

In addition, in this embodiment, no roping mechanism is used, and the full width of the web is maintained throughout the operation. In other embodiments, a roping mechanism may be used to selectively narrow the web. In still other embodiments, a roping mechanism may be used to form a complete rope from the web, and remain engaged throughout the operation such that a rope of packaging material is wrapped in the aforementioned cross wrap sequence.

The resulting wrap pattern illustrated in FIG. 31 secures the top or slip sheet 784 proximate each of the four corners of the load. In addition, it will be appreciated that by controlling the elevation of the web, the width of the web (e.g., via a roping mechanism), and the other factors discussed above in connection with FIGS. 8-9, the configuration and appearance of the wrapped load may be controlled for functional and/or aesthetic concerns, e.g., to provide a balanced or symmetrical appearance of the packaging material from all sides with the web passing inwardly a similar distance from each corner of the load. It will also be appreciated that wrap force and other parameters may also be varied in the manner described above during increases and/or decreases in the elevation of the web, particularly for easily-deformable loads with which slip sheets are often used.

It will further be appreciated that it may be desirable in some embodiments for a cross wrap sequence to pass only a portion of a width of a web inwardly of the corners such that an edge of the web "catches" the corners. In some embodiments, for example, doing so may cause the web of packaging material to spread out to a maximum width across the top surface, rather than bunch together with a narrower width as may occur in some instances when the web of packaging material is passed entirely inwardly of the corners.

In addition, it may also be desirable to utilize a similar wrapping pattern as illustrated in FIGS. 29-31 even when no top sheet or slip sheet is used. In particular, in a load that includes easily crushable or deformable articles in a top layer, the aforementioned cross wrap pattern may be used to enhance containment of the top layer while reducing potential deformation or damage of such articles. The passage of the web inwardly of the corners may apply some degree of "vertical" containment force to the load, and in some instances, may permit the wrap force used to apply packaging material to the top layer of a load to be reduced (including the wrap force used during a top layer containment operation and/or the wrap force used during spiral wrapping proximate the top layer of the load).

Figure 32:
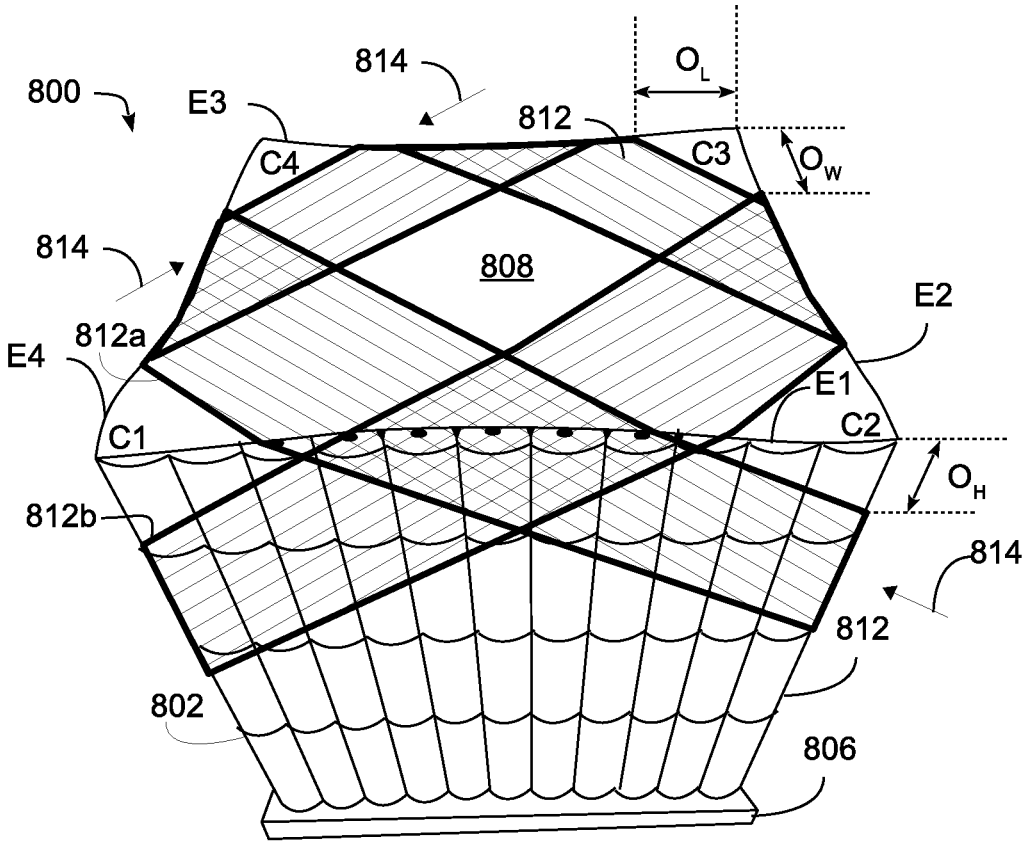
FIG. 32 is a perspective view of an example load including an easily deformable top layer and an example wrapping operation performed thereon.

FIG. 32, for example, illustrates an example load 800 including a substantially cuboid main body 802 supported on a pallet 806. A top or slip sheet 808 is illustrated in FIG. 32, but it will be appreciated that in some embodiments, no such sheet may be used. In this example, load 800 includes easily-deformable articles such as uncartoned paper towel rolls 812. Four corners C1-C4 are defined on the load, with corners C1 and C3 forming one pair of opposing corners and corners C2 and C4 forming another pair of opposing corners. Also illustrated are four top edges E1-E4 adjoining the top surface and sides of the load.

A top layer containment operation including a cross wrap sequence is also illustrated, with a web 812 of packaging material applied to the load in a manner such that any compression of the load by the packaging material applied in the operation occurs inwardly of the corners, e.g., as illustrated by arrows 814. Further, it may be seen that bottom edge 812*a* of web 812 passes entirely inwardly of each corner C1-C4 of along each side of the load 800, e.g., by the offset distances labeled $O_L$ and $O_W$. Further, in some embodiments, where web 812 engages a corner C1-C4, the elevation of the web 812 may be controlled such that a top edge 812*b* thereof is additionally offset from the intersection of the top surface and the adjoining sides by an offset distance labeled $O_H$. By doing so, areas proximate corners C1-C4 are subjected to reduced compressional forces, while overall containment of the load is maintained.

As with the embodiment of FIGS. 29-31, no roping mechanism is used with the operation illustrated in FIG. 32, and the full width of the web is maintained throughout the operation. In other embodiments, a roping mechanism may be used to selectively narrow the web and/or fully collapse the web into a rope.

Automatic Selection of Top Layer Containment Operations

It will be appreciated that in some embodiments, multiple top layer containment operations may be supported and selected and/or customized for different applications. Selection and/or customization of different top layer containment operations may be performed by an operator in some embodiments, while in other embodiments, selection and/or customization may be performed automatically, e.g., based upon one or more characteristics of a load. In addition, in some embodiments, a top layer containment operation may be incorporated into a load profile that specifies other types of wrap parameters to control an overall wrapping operation.

In one embodiment, automatic profiling of a load may be performed, e.g., based upon a three-dimensional profile of the top of the load determined from an overhead sensor. Profiling may select, for example, whether or not to perform a top layer containment operation, and if so, whether to perform a U wrap pattern or a cross wrap pattern. For example, for relatively tall inboard loads that overlap the center of rotation of the load, a U wrap pattern may be selected, whereas for relatively short inboard loads (e.g., less than about 6 inches high), a cross wrap pattern may be selected. In addition, a cross wrap pattern may also be selected in order to secure a top or slip sheet, or when it is desirable to increase containment force at the top of a cuboid-shaped load, particularly a cuboid-shaped load having easily deformable products. Automatic load profiling is discussed in greater detail in U.S. Provisional Application No. 62/232,915, filed on Sep. 25, 2015 by Patrick R. Lancaster III et al., which is incorporated by reference herein.

Other embodiments will be apparent to those skilled in the art from consideration of the specification and practice of the present invention. Therefore the invention lies in the claims set forth hereinafter.

What is claimed is:

1. A method of securing an inboard portion of a load to a supporting body with a load wrapping apparatus, the supporting body including a plurality of corners, the method comprising:

providing relative rotation between the load and a packaging material dispenser about an axis of rotation to dispense packaging material to the load;

controlling an elevation of a web of the packaging material extending between the packaging material dispenser and the load generally parallel to the axis of rotation; and securing the inboard portion of the load to the supporting body within a revolution between the load and the packaging material dispenser by:

wrapping packaging material around a first corner of the supporting body while controlling the elevation of the web by controlling the elevation of at least a portion of the packaging material dispenser to engage the first corner of the supporting body of the load with a bottom edge of the web;

after wrapping the packaging material around the first corner of the supporting body, wrapping packaging material around the inboard portion of the load on a side of the load opposite the first corner of the supporting body while controlling the elevation of the web by controlling the elevation of at least a portion of the packaging material dispenser to engage the inboard portion of the load with the bottom edge of the web and entirely pass inwardly of at least two subsequent corners of the supporting body of the load; and after wrapping the packaging material around the inboard portion of the load and passing inwardly of at least two subsequent corners of the supporting body of the load, wrapping packaging material around at least one corner of the supporting body while controlling the elevation of the web by controlling the elevation of at least a portion of the packaging material dispenser to engage the supporting body with the bottom edge of the web.

2. The method of claim 1, wherein the plurality of corners further includes second, third and fourth corners, wherein wrapping packaging material around the inboard portion of the load causes the web of packaging material to pass inwardly of the second and third corners, and wherein wrapping packaging material around the at least one corner of the supporting body after wrapping the packaging material around the inboard portion of the load includes wrapping the packaging material around at least one of the first and fourth corners.

3. The method of claim 2, wherein controlling the elevation of the web includes controlling an elevation of a packaging material dispenser elevator.

4. The method of claim 3, wherein controlling the elevation of the web includes selectively engaging a roping mechanism that when engaged forms a rope on the bottom edge of the web and raises the elevation of the bottom edge of the web relative to the packaging material dispenser elevator.

5. The method of claim 3, further comprising slowing or pausing the relative rotation during the revolution to provide sufficient time to enable the web to reach an elevation that enables the web to pass inwardly of the second corner.

6. The method of claim 3, wherein controlling the elevation of the web includes maintaining an open web while controlling the elevation of the web.

7. The method of claim 3, wherein controlling the elevation of the web includes maintaining a substantially same amount of tilt to the web during the revolution.

8. The method of claim 3, wherein controlling the elevation of the web includes selectively narrowing between open and partially narrowed webs while controlling the elevation of the web.

9. The method of claim 2, further comprising applying a rotational data shift to adjust a relative timing of at least one control signal used to control the elevation of the web to account for system lag.

10. The method of claim 2, wherein wrapping packaging material around the at least one corner of the supporting body after wrapping the packaging material around the inboard portion of the load includes wrapping the packaging material around the fourth corner.

11. The method of claim 2, wherein wrapping packaging material around the inboard portion of the load additionally passes the web of packaging material inwardly of the fourth corner, and wherein wrapping packaging material around the at least one corner of the supporting body after wrapping the packaging material around the inboard portion of the load includes wrapping the packaging material around the first corner.

12. The method of claim 1, wherein the supporting body comprises a main body of the load.

13. The method of claim 1, wherein the supporting body comprises a pallet.

14. The method of claim 1, wherein the inboard portion is non-rectangular in cross-section.

15. The method of claim 1, wherein:

each of the plurality of corners is associated with a rotational angle between the load and the packaging material dispenser about the axis of rotation;

wrapping packaging material around the first corner of the supporting body includes controlling the elevation of the web to engage the first corner of the supporting body of the load across about 50% of a width of the web;

wrapping packaging material around the inboard portion of the load on a side of the load opposite the first corner of the supporting body includes raising an elevation of the bottom edge of the web above an elevation of the supporting body starting at a first predetermined rotational angle between the rotational angle associated with the first corner and the rotational angle associated with another of the plurality of corners; and wrapping packaging material around the at least one corner of the supporting body includes lowering the elevation of the bottom edge of the web below the elevation of the supporting body starting at a second predetermined rotational angle between rotational angles associated with two sequential corners among the plurality of corners.

16. The method of claim 1, further comprising lowering a wrap force during the revolution to minimize shifting of the inboard portion of the load.

17. The method of claim 1, further comprising repeating the revolution starting at a corner other than the first corner of the supporting body.

18. The method of claim 1, wherein the revolution is a first revolution, wherein wrapping packaging material around the first corner, wrapping packaging material around the inboard portion of the load, and wrapping packaging material around the at least one corner define a sequence of operations, and wherein the method further comprises, in at least one additional revolution, repeating the sequence of operations starting at a corner other than the first corner of the supporting body.

19. The method of claim 18, further comprising repeating the sequence of operations starting at the first corner of the supporting body.

20. The method of claim 18, wherein the first revolution and the at least one additional revolution apply packaging material to the inboard portion of the load over a plurality of revolutions to secure the inboard portion of the load to the supporting body.

21. A method of securing an inboard portion of a load to a supporting body with a load wrapping apparatus, the load including first and second opposing sides, the supporting body including first and second corners disposed proximate the first side of the load, the method comprising:

providing relative rotation between the load and a packaging material dispenser about an axis of rotation to dispense packaging material to the load;

dispensing a web of the packaging material from the packaging material dispenser to the load during the relative rotation; and securing the inboard portion of the load to the supporting body within a revolution between the load and the packaging material dispenser by bidirectionally changing an elevation of the web generally parallel to the axis of rotation during the revolution to engage a bottom edge of the web with the supporting body around each of the first and second corners and to engage the bottom edge of the web with the inboard portion of the load around the second side of the load and entirely pass inwardly of a third corner disposed opposite the first corner, wherein bidirectionally changing the elevation of the web is performed by controlling an elevation of at least a portion of the packaging material dispenser.

22. The method of claim 21, wherein the supporting body further includes third and fourth corners, wherein the revolution is a first revolution, the method further comprising further securing the inboard portion of the load to the supporting body within a second revolution between the load and the packaging material dispenser by bidirectionally changing the elevation of the web generally parallel to the axis of rotation during the second revolution to engage the bottom edge of the web with the supporting body around each of the third and fourth corners and to engage the bottom edge of the web with the inboard portion of the load around the first side of the load.

23. A method of securing an inboard portion of a load to a supporting body with a load wrapping apparatus, the load including first and second opposing sides, the supporting body including a corner disposed proximate the first side of the load, the method comprising:

providing relative rotation between the load and a packaging material dispenser about an axis of rotation to dispense packaging material to the load;

dispensing a web of the packaging material from the packaging material dispenser to the load during the relative rotation; and securing the inboard portion of the load to the supporting body within a revolution between the load and the packaging material dispenser by bidirectionally changing an elevation of the web generally parallel to the axis of rotation during the revolution to engage a bottom edge of the web with the supporting body around the corner at a beginning and an end of the revolution and to engage the bottom edge of the web with the inboard portion of the load around the second side of the load and entirely pass inwardly of a third corner disposed opposite the first corner, wherein bidirectionally changing the elevation of the web is performed by controlling an elevation of at least a portion of the packaging material dispenser.

24. The method of claim 23, wherein the corner is a first corner, wherein the supporting body further includes second, third and fourth corners, wherein the revolution is a first revolution, the method further comprising further securing the inboard portion of the load to the supporting body within second, third and fourth revolutions between the load and the packaging material dispenser by, within each of the second, third and fourth revolutions, bidirectionally changing the elevation of the web generally parallel to the axis of rotation to engage the bottom edge of the web with the supporting body around one of the second, third and fourth corners at a beginning and an end of such revolution and to engage the bottom edge of the web with the inboard portion of the load.

25. A method of securing an inboard portion of a load to a supporting body with a load wrapping apparatus that controls an elevation of a web of packaging material dispensed from a packaging material dispenser while providing relative rotation between the load and the packaging material dispenser about an axis of rotation, the method comprising, within a revolution between the load and the packaging material dispenser, and while maintaining an amount of tilt to the web during the revolution:

controlling the elevation of the web during the relative rotation to engage a first corner of the supporting body across at least a portion of a width of the web;

prior to further relative rotation to a rotational angle corresponding to a second corner of the supporting body that is opposite the first corner, raising the elevation of the web to position a bottom edge of the web above the supporting body, wherein raising the elevation of the web includes moving the packaging material dispenser and/or engaging a roping mechanism to narrow a width of the web;

after raising the elevation of the web to position the bottom edge of the web above the supporting body, controlling the elevation of the web during the relative rotation past the rotational angle corresponding to the second corner to engage the bottom edge of the web with the inboard portion of the load instead of the second corner of the supporting body; and after relative rotation past the rotational angle corresponding to the second corner, lowering the elevation of the web to engage a subsequent corner of the supporting body across at least a portion of the width of the web after further relative rotation, wherein at least a portion of the web having the bottom edge thereof engaged with the inboard portion is raised to an elevation such that at least a first portion of the web engages a top surface of the inboard portion of the load and a second portion of the web engages a side surface of the inboard portion of the load.

26. The method of claim 25, wherein controlling the elevation of the web to engage the first corner, raising the elevation of the web to position the bottom edge of the web above the supporting body, controlling the elevation of the web past the rotational angle corresponding to the second corner and lowering the elevation of the web to engage the subsequent corner are performed using a sequence of operations within a first revolution, the method further comprising repeating the sequence of operations in a plurality of revolutions and starting at different corners of the supporting body to further secure the inboard portion to the supporting body.

27. The method of claim 25, wherein controlling the elevation of the web to engage the first corner, raising the elevation of the web to position the bottom edge of the web above the supporting body, controlling the elevation of the web past the rotational angle corresponding to the second corner and lowering the elevation of the web to engage the subsequent corner are based upon at least one predetermined elevation that is relative to a height of the supporting body or of the inboard portion of the load.

28. The method of claim 27, further comprising sensing the height of the supporting body with a sensor and determining the at least one predetermined elevation from the sensed height.

29. The method of claim 28, wherein determining the at least one predetermined elevation from the sensed height includes applying a predetermined offset to the sensed height of the supporting body, wherein the predetermined offset is based upon a dimensional height of the inboard portion of the load.

30. The method of claim 27, further comprising sensing the height of the inboard portion of the load with a sensor and determining the at least one predetermined elevation from the sensed height.

31. The method of claim 30, wherein the sensor is adjustably-mounted to the packaging material dispenser and is adjustable among a plurality of positions relative to the packaging material dispenser to compensate for a dimensional height of the inboard portion of the load.

32. The method of claim 30, wherein the sensor is fixedly-mounted to the packaging material dispenser at a predetermined offset elevation to sense a top of the inboard portion of the load when less than about 75% of the web is at a higher elevation than a top of the supporting body.

33. A method of securing an inboard portion of a load to a supporting body with a load wrapping apparatus, the inboard portion of the load including a plurality of quadrants respectively associated with a plurality of corners of the supporting body, the method comprising:

providing relative rotation between the load and a packaging material dispenser about an axis of rotation to dispense packaging material to the load;

controlling an elevation of a web of the packaging material extending between the packaging material dispenser and the load direction generally parallel to the axis of rotation; and during each one of a plurality of revolutions, controlling the elevation of the web by controlling an elevation of at least a portion of the packaging material dispenser during the relative rotation to wrap packaging material around at least one corner of the supporting body across at least a portion of a width of the web, to thereafter wrap packaging material around at least one quadrant of the inboard portion of the load that is associated with a different corner that is opposite the at least one corner with a bottom edge of the web engaging the inboard portion of the load and positioned at a higher elevation than the supporting body, and to thereafter wrap packaging material around at least one corner of the supporting body across at least a portion of the width of the web.

34. A method of securing an inboard portion of a load with a load wrapping apparatus, the method comprising:

providing relative rotation between a load and a packaging material dispenser about an axis of rotation to dispense packaging material to the load;

controlling an elevation of a web of the packaging material extending between the packaging material dispenser and the load in a direction generally parallel to the axis of rotation during the relative rotation;

controlling a width of the web between first and second widths, wherein the second width is narrower than the first width; and passing the web inwardly of a corner of the load or a pallet upon which the load is supported during the relative rotation by controlling the width of the web to narrow the web to the second width prior to contact of the web with the corner when the controlled elevation of the web is such that the web would contact the corner if the controlled width of the web is the first width.

35. An apparatus, comprising:

a packaging material dispenser configured to dispense a web of packaging material to a load;

a first drive mechanism configured to generate relative rotation between the packaging material and the load about an axis of rotation;

a second drive mechanism configured to control an elevation of the web of packaging material generally parallel to the axis of rotation; and a controller coupled to the first and second drive mechanism, the controller configured to:

determine a rotational angle of the load relative to the packaging material dispenser about the axis of rotation;

determine the elevation of the packaging material dispenser relative to the load; and secure an inboard portion of the load to a supporting body by, within a revolution between the load and the packaging material dispenser, and while maintaining an amount of tilt to the web during the revolution:

causing the first drive mechanism to generate relative rotation between the load and the packaging material dispenser;

at a first predetermined rotational angle, causing the second drive mechanism to control the elevation of the web to engage a first corner of the supporting body across at least a portion of a width of the web;

at a second predetermined rotational angle prior to a rotational angle corresponding to a second corner of the supporting body, causing the second drive mechanism to raise the elevation of the web to position a bottom edge of the web above the supporting body;

after raising the elevation of the web to position the bottom edge of the web above the supporting body, causing the second drive mechanism to control the elevation of the web past the rotational angle corresponding to the second corner to engage the inboard portion of the load instead of the second corner of the supporting body; and after relative rotation past the rotational angle corresponding to the second corner, causing the second drive mechanism to lower the elevation of the web to engage a subsequent corner of the supporting body across at least a portion of the width of the web after further relative rotation, wherein at least a portion of the web having the bottom edge thereof engaged with the inboard portion is raised to an elevation such that at least a first portion of the web engages a top surface of the inboard portion of the load and a second portion of the web engages a side surface of the inboard portion of the load.

36. The apparatus of claim 35, further comprising a roping mechanism configured to selectively narrow a width of the web and raise an elevation of a bottom edge of the web, wherein the controller is configured to control the roping mechanism in association with controlling the second drive mechanism to control the elevation of the web.

37. The apparatus of claim 35, wherein the controller is further configured to control the elevation of the web to engage the first corner, raise the elevation of the web to position the bottom edge of the web above the supporting body, control the elevation of the web past the rotational angle corresponding to the second corner and lower the elevation of the web to engage the subsequent corner using a sequence of operations within a first revolution, and wherein the controller is further configured to repeat the sequence of operations in a plurality of revolutions and starting at different corners of the supporting body to further secure the inboard portion to the supporting body.

38. The apparatus of claim 35, further comprising a sensor coupled to the packaging material dispenser to sense a top of the supporting body, wherein the controller is configured to cause the second drive mechanism to move the packaging material dispenser and the sensor in a direction generally parallel to the axis of rotation when no relative rotation is being generated between the load and the packaging material dispenser to determine a height of the supporting body based upon a determined elevation of the packaging material dispenser when the top of the supporting body is sensed.

39. An apparatus, comprising:

a packaging material dispenser configured to dispense a web of packaging material to a load;

a first drive mechanism configured to generate relative rotation between the packaging material and the load about an axis of rotation;

a second drive mechanism configured to control an elevation of the web of packaging material generally parallel to the axis of rotation; and a controller coupled to the first and second drive mechanism, the controller configured to:

determine a rotational angle of the load relative to the packaging material dispenser about the axis of rotation;

determine the elevation of the packaging material dispenser relative to the load; and secure an inboard portion of the load to a supporting body by:

causing the first drive mechanism to generate relative rotation between the load and the packaging material dispenser;

at a first predetermined rotational angle, causing the second drive mechanism to control the elevation of the web to engage a first corner of the supporting body across at least a portion of a width of the web;

at a second predetermined rotational angle prior to a rotational angle corresponding to a second corner of the supporting body, causing the second drive mechanism to raise the elevation of the web to position a bottom edge of the web above the supporting body;

after raising the elevation of the web to position the bottom edge of the web above the supporting body, causing the second drive mechanism to control the elevation of the web past the rotational angle corresponding to the second corner to engage the inboard portion of the load instead of the second corner of the supporting body; and after relative rotation past the rotational angle corresponding to the second corner, causing the second drive mechanism to lower the elevation of the web to engage a subsequent corner of the supporting body across at least a portion of the width of the web after further relative rotation;

wherein the apparatus further comprises a first sensor coupled to the packaging material dispenser and directed off-axis relative to the axis of rotation to sense a top of the supporting body and a second sensor coupled to the packaging material dispenser and directed to sense a top of the inboard portion of the load, and wherein the controller is configured to determine a height of the supporting body based upon a first determined elevation of the packaging material dispenser when the top of the supporting body is sensed with the first sensor and to determine a height of the inboard portion of the load based upon a second determined elevation of the packaging material dispenser when the top of the inboard portion of the load is sensed with the second sensor.

40. The apparatus of claim 39, wherein the second sensor is directed toward the axis of rotation.

41. An apparatus, comprising:

a packaging material dispenser configured to dispense a web of packaging material to a load, the load including an inboard portion supported by a supporting body;

a first drive mechanism configured to generate relative rotation between the packaging material and the load about an axis of rotation;

a second drive mechanism configured to control an elevation of the web of packaging material generally parallel to the axis of rotation;

a first sensor coupled to the packaging material dispenser and directed off-axis relative to the axis of rotation to sense a top of the supporting body;

a second sensor coupled to the packaging material dispenser and directed to sense a top of the inboard portion of the load; and a controller coupled to the first and second drive mechanisms, the controller configured to:

determine a rotational angle of the load relative to the packaging material dispenser about the axis of rotation;

determine the elevation of the packaging material dispenser relative to the load;

prior to relative rotation between the load and the packaging material dispenser, cause the second drive mechanism to move the packaging material dispenser and the first and second sensors in a direction generally parallel to the axis of rotation to determine a height of the supporting body based upon a first determined elevation of the packaging material dispenser when the top of the supporting body is sensed with the first sensor and to determine a height of the inboard portion of the load based upon a second determined elevation of the packaging material dispenser when the top of the inboard portion of the load is sensed with the second sensor; and secure the inboard portion of the load to the supporting body by:

causing the first drive mechanism to generate relative rotation between the load and the packaging material dispenser;

at a first predetermined rotational angle, causing the second drive mechanism to control the elevation of the web relative to the determined height of the supporting body to engage a first corner of the supporting body across at least a portion of a width of the web;

at a second predetermined rotational angle prior to a rotational angle corresponding to a second corner of the supporting body, causing the second drive mechanism to raise the elevation of the web to position a bottom edge of the web above the supporting body;

after raising the elevation of the web to position the bottom edge of the web above the supporting body, causing the second drive mechanism to control the elevation of the web past the rotational angle corresponding to the second corner and relative to the determined height of the inboard portion of the load to engage the inboard portion of the load instead of the second corner of the supporting body; and after relative rotation past the rotational angle corresponding to the second corner, causing the second drive mechanism to lower the elevation of the web relative to the determined height of the supporting body to engage a subsequent corner of the supporting body across at least a portion of the width of the web after further relative rotation.

* * * * *